US007158256B2

(12) United States Patent
Kitawaki et al.

(10) Patent No.: US 7,158,256 B2
(45) Date of Patent: Jan. 2, 2007

(54) METHOD OF RECORDING IMAGE AND IMAGE RECORDER

(75) Inventors: Shiro Kitawaki, Kyoto (JP); Kazuma Kan, Kyoto (JP); Arifumi Omoto, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 817 days.

(21) Appl. No.: 10/335,911

(22) Filed: Jan. 3, 2003

(65) Prior Publication Data

US 2003/0127004 A1 Jul. 10, 2003

(30) Foreign Application Priority Data

Jan. 7, 2002 (JP) ..... P2002-000211

(51) Int. Cl.
*B41F 27/06* (2006.01)

(52) U.S. Cl. ..... 358/1.15; 101/382.1; 101/481

(58) Field of Classification Search ..... 355/405; 271/250, 276; 101/486, 477, 463, 400
See application file for complete search history.

(56) References Cited

U.S. PATENT DOCUMENTS 4,742,772 A * 5/1988 Grose ..... 101/415.1
5,337,486 A * 8/1994 Brechtel ..... 33/617
5,842,397 A * 12/1998 Shimizu et al. ..... 83/54
6,016,752 A * 1/2000 Harari ..... 101/486
6,213,020 B1 * 4/2001 Kawada et al. ..... 101/486
6,559,930 B1 * 5/2003 Ozaki ..... 355/405
6,662,725 B1 * 12/2003 Koizumi et al. ..... 101/486
6,664,999 B1 * 12/2003 Ohba et al. ..... 347/242
6,668,722 B1 * 12/2003 Fukui ..... 101/415.1
6,840,173 B1 * 1/2005 Kawabata et al. ..... 101/415.1
2001/0022428 A1 * 9/2001 Hebert et al. ..... 271/276
2002/0002922 A1 * 1/2002 Stellberger ..... 101/415.1
2003/0075860 A1 * 4/2003 Hashiguchi et al. ..... 271/250
2003/0097946 A1 * 5/2003 Kawabata et al. ..... 101/415.1
2003/0106449 A1 * 6/2003 Kawamura et al. ..... 101/477
2003/0188654 A1 * 10/2003 Shih ..... 101/463.1
2004/0040456 A1 * 3/2004 Wolber ..... 101/401.1

FOREIGN PATENT DOCUMENTS

JP 04-250095 9/1992
JP 08-328267 12/1996

* cited by examiner

*Primary Examiner*—Kimberly Williams
*Assistant Examiner*—Ashish K. Thomas
(74) *Attorney, Agent, or Firm*—McDermott Will & Emery LLP

(57) ABSTRACT

An image recorder and a method of recording an image on a printing plate are provided. A punch unit for forming punched holes and the like for use in a printing apparatus in the printing plate positions the printing plate by bringing a pair of reference pins into contact with an edge of the printing plate, and punches the printing plate. Next, the printing plate is transferred to a recording drum in the image recorder for image recording. The recording drum is provided with positioning pins mounted upright in substantially the same location as the reference pins of the punch unit. Thus, a portion of the edge of the printing plate which made contact with the reference pins of the punch unit is also brought into contact with the positioning pins of the recording drum. Therefore, the positional relationship between the punches holes for printing and the recorded image is held constant without being affected by an undulation or swell on the edge of the printing plate.

10 Claims, 23 Drawing Sheets

METHOD OF RECORDING IMAGE AND IMAGE RECORDER

BACKGROUND OF THE INVENTION

1. Field of the Invention

The present invention relates to a technique for positioning a printing plate in an image recorder for recording a printing image on the printing plate.

2. Description of the Background Art

An image recorder known as a CTP (Computer to Plate) or a platesetter records an image for each color on a printing plate for use in printing. After the image recording, the printing plate is attached to a plate cylinder of a printing machine. A plurality of printing plates are used to print a plurality of images of respective colors one upon another on a single printing sheet, thereby forming a multi-color image on the printing sheet.

The operation of attaching a printing plate to the plate cylinder of the printing machine is performed with reference to punched holes for registration or positioning which are previously formed in predetermined locations in the printing plate.

All printing plates must have the same positional relationship between the punched holes for registration and recorded images on the printing plates, or a misregistration would occur between the images transferred onto the printing sheet. The conventional operation will be described with reference to FIGS. 22A, 22B, 22C, 23A, 23B and 23C.

The conventional operation is performed using an image recorder 110, a punching apparatus 120, and a printing apparatus 130.

Referring to FIG. 22A, the image recorder 110 generally comprises a recording drum 111 for mounting a printing plate P thereon; a recording head 112 for directing an optical beam modulated in accordance with an image signal onto the printing plate P; a motor 113 for rotating the recording drum 111; and a sub-scanning motor 114 and a feed screw 115 for moving the recording head 112 in the axial direction of the recording drum 111. A first pin 116 and a second pin 117 for positioning the printing plate P are mounted upright on the surface of the recording drum 111.

The printing plate P is positioned on the outer peripheral surface of the recording drum 111 by bringing an edge Pe of the printing plate P into contact with the first and second pins 116 and 117, and is secured on the outer peripheral surface of the recording drum 111 by a vacuum suction means or other securing means.

Thereafter, the recording head 112 records an image IM on the printing plate P. It is assumed that the recorded image IM is an image IM (C) corresponding to the cyan color in this case.

After the completion of the image recording in the image recorder 110, the printing plate P is removed from the recording drum 111, and is transported to the punching apparatus 120. As schematically illustrated in FIG. 22B, the punching apparatus 120 comprises a punch table 121 for securing the printing plate P thereon; a first punching registration pin 126 and a second punching registration pin 127 for positioning the printing plate P on the punch table 121; and a punch unit (not shown) for punching the printing plate P.

The printing plate P is positioned on the punch table 121 by bringing the edge Pe thereof into contact with the first and second punching registration pins 126 and 127. Thereafter, the punch unit punches the printing plate P to form punched holes Pi and Pj.

Next, the printing plate P is transported to the printing apparatus 130. As schematically illustrated in FIG. 22C, the printing apparatus 130 comprises a plate cylinder 131 for placing the printing plate P therearound; and a first printing registration pin 136 and a second printing registration pin 137 for positioning the printing plate P on the plate cylinder 131. Although not shown, the printing apparatus 130 further comprises a securing device for securing the printing plate P around the plate cylinder 131, an ink supply device, a water supply device, and a printing paper feeding device.

The printing plate P is positioned on the plate cylinder 131 by bringing the punched holes Pi and Pj into engagement with the first and second printing registration pins 136 and 137, respectively, and is then secured thereon by the securing device not shown. Thereafter, the ink supply device and the water supply device transfer the image IM (C) from the printing plate P to a printing sheet fed from the printing paper feeding device.

The printing plate P is produced by cutting a plate of metal, e.g. aluminum, to length and forming a layer for image formation on the surface thereof. Generally, the printing plate P is produced so that the edge Pe is straight. In some cases, however, the edge Pe has an undulation or swell Pw, as shown in FIG. 23A, due to low manufacturing accuracy or external factors after the manufacture. Thus, the printing plate P having the edge Pe which is not straight causes misregistration of the multi-color image formed on the printing sheet, which will be described in detail.

A problem arising from the operation using the image recorder 110, the punching apparatus 120 and the printing apparatus 130 discussed above will be described with reference to FIGS. 23A, 23B and 23C. It is assumed that the undulation or swell Pw is formed at a portion of the edge Pe of the printing plate P which is to come into contact with the second punching registration pin 127.

The printing plate P is positioned on the recording drum 111 of the image recorder 110 and is then secured thereon in the above-mentioned procedure. In this process, since the undulation or swell Pw on the edge Pe of the printing plate P does not contact the first and second pins 116 and 117, the printing plate P is properly positioned, and the proper image IM is recorded on the printing plate P. It is assumed that the recorded image IM is an image IM (M) corresponding to the magenta (M) color in this case.

The image is properly recorded on the printing plate P in this manner. However, the printing plate P is secured in an inclined orientation on the punch table 121 of the punching apparatus 120 since the printing plate P is positioned with the undulation or swell Pw in contact with the second punching registration pin 127. This produces the punched holes Pi and Pj displaced from their intended locations.

In the printing apparatus 130, the printing plate P is positioned by bringing the displaced holes Pi and Pj into engagement with the first and second printing registration pins 136 and 137. Thus, the image IM (M) recorded on the printing plate P assumes an angular orientation different from its intended angular orientation when the printing plate P is mounted on the plate cylinder 131. This results in misregistration when the image IM (M) of the magenta color is printed over the image IM (C) of the cyan color on the printing sheet.

Although the punched holes for use in the printing apparatus are produced in the punching apparatus 120 separate from the image recorder 110 in the above-mentioned instance, the above-mentioned problem arises also when the punching apparatus 120 is provided in the image recorder.

Additionally, there is a likelihood that similar misregistration occurs when an image is formed with reference to the plate edge and the plate is punched by means of another punching apparatus.

SUMMARY OF THE INVENTION

The present invention is intended for a technique for positioning a printing plate in an image recorder for recording a printing image on the printing plate.

According to the present invention, the image recorder comprises: a) a transport element for transporting the printing plate to a predetermined position; b) a reference position determining element for determining a predetermined reference position on the printing plate, the reference position determining element including b-1) a first holding element for holding a first portion of the printing plate, b-2) at least one second holding element for holding a second portion of the printing plate, the first holding element and the at least one second holding element being spaced apart from each other in a direction perpendicular to a direction in which the printing plate is transported to the reference position determining element, b-3) a first reference establishing element for establishing a first reference indication for image recording in the printing plate, and b-4) a second reference establishing element for establishing a second reference indication for printing in the printing plate; and c) a recording element for recording a printing image on the printing plate, the recording element including c-1) a third holding element for holding a third portion of the printing plate, c-2) at least one fourth holding element for holding a fourth portion of the printing plate, and c-3) an image recording element for recording a printing image on the printing plate, wherein the third holding element and the at least one fourth holding element are provided to satisfy the following conditions: (i) the third holding element and the at least one fourth holding element are spaced apart from each other in a direction substantially perpendicular to a direction in which the printing plate is transported to the recording element; (ii) the positional relationship between the third holding element and the at least one fourth holding element relative to each other in a horizontal plane is identical with the positional relationship between the first reference establishing element and the at least one second holding element relative to each other in a horizontal plane; (iii) the fourth portion held by the at least one fourth holding element coincides with the second portion held by the at least one second holding element; and (iv) the positional relationship between the at least one fourth holding element and the printing plate relative to each other in a horizontal plane is identical with the positional relationship between the at least one second holding element and the printing plate relative to each other in a horizontal plane in the reference position determining element.

Preferably, the first and second reference establishing elements are first and second punching elements, respectively, for punching the printing plate. The first reference indication is a notch formed by the first punching element, and the second reference indication is a hole formed by the second punching element.

The first reference indication and the second reference indication are formed at the same time by punching. The printing plate during the punching is held in the same orientation as the printing plate during image recording. Thus, the positional relationship between the second reference indication and the recorded image relative to each other is held constant. This prevents misregistration in multi-color printing using a plurality of printing plates.

It is therefore an object of the present invention to provide an image recorder free from misregistration, and a method of recording an image in the image recorder.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
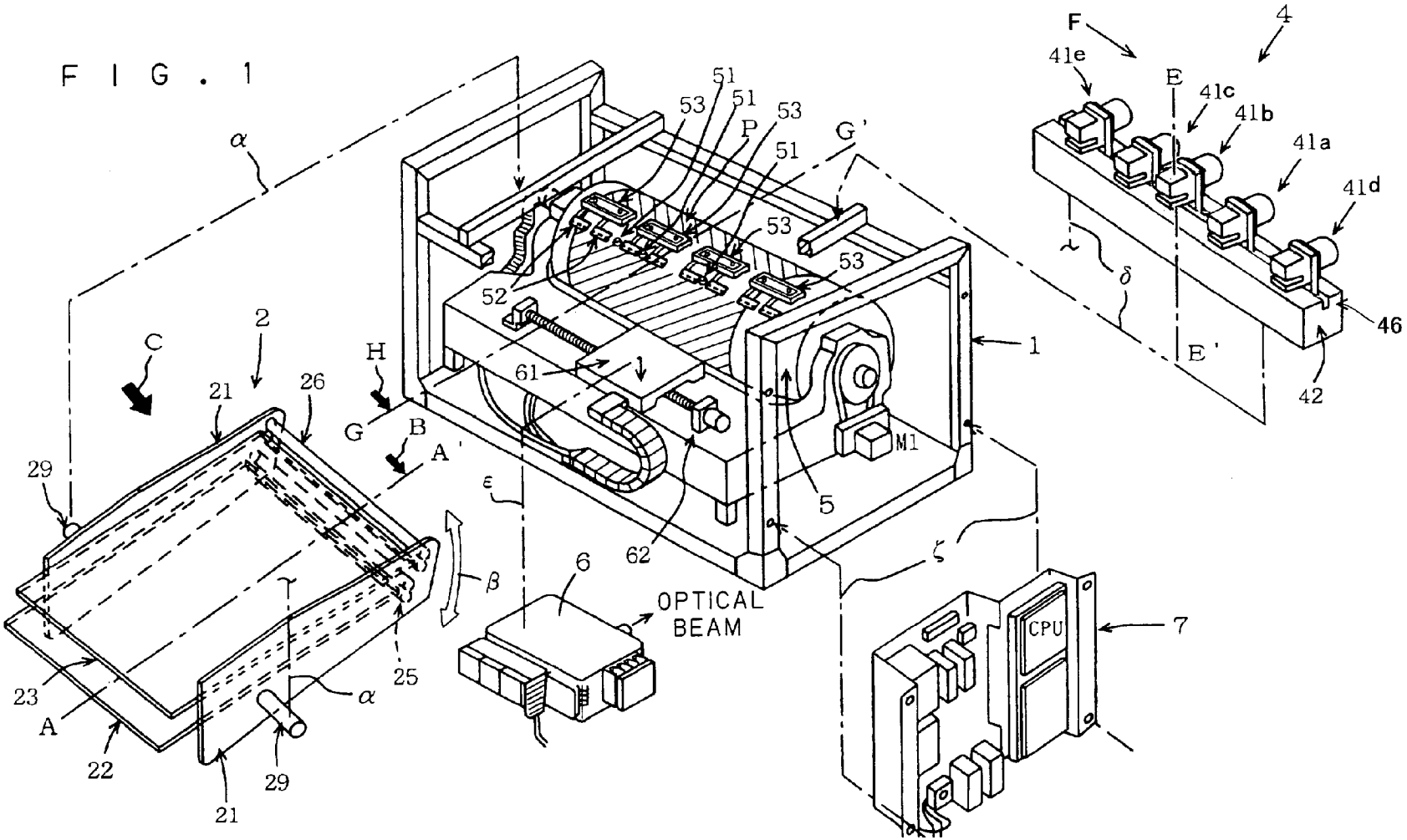
FIG. 1 is an exploded view showing the construction of an image recorder according to one preferred embodiment of the present invention.

FIG. 1 is an exploded view showing the construction of an image recorder according to one preferred embodiment of the present invention. The image recorder according to the present invention comprises a frame 1 having approximately the shape of a rectangular parallelepiped. A storage/transport mechanism 2, a drive mechanism 3, a punch unit 4, a recording drum 5, an exposure head 6, and an electrical component 7 are mounted generally to respective portions of the frame 1. The drive mechanism 3 is not shown in FIG. 1 for purposes of clarity.

Figure 2:
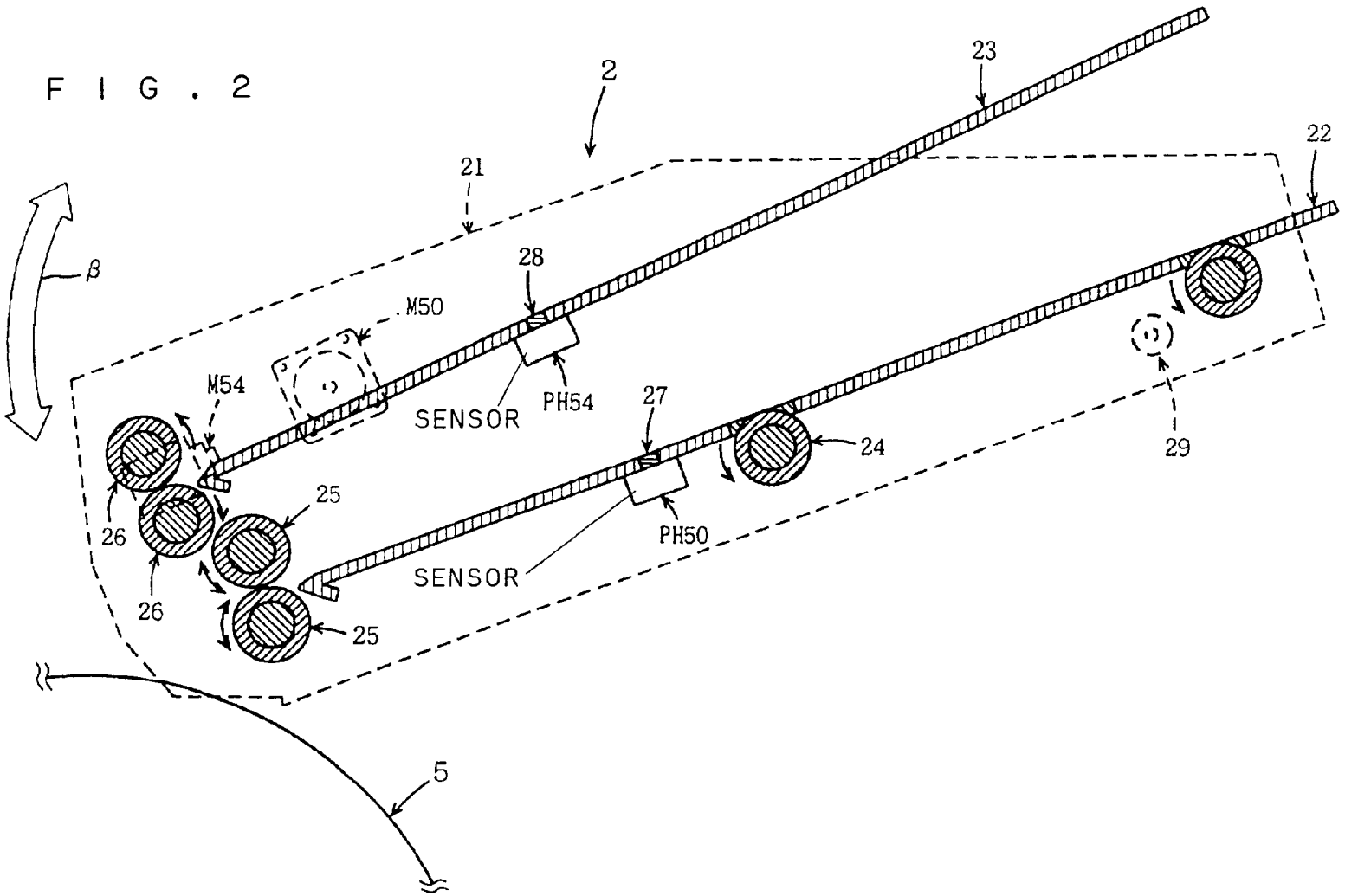
FIG. 2 is a sectional view of a storage/transport mechanism taken along the dash-dot line A–A' of FIG. 1 as seen in the direction indicated by the arrow B.

FIG. 2 is a sectional view of the storage/transport mechanism 2 taken along the dash-dot line A–A' of FIG. 1 as seen in the direction indicated by the arrow B. It should be noted that not all components shown in FIG. 2 are shown in FIG. 1. Referring to FIGS. 1 and 2, the storage/transport mechanism 2 comprises a pair of trays 22 and 23 held and secured between a pair of side plates 21, a feed roller 24, a pair of loading transport rollers 25, and a pair of unloading transport rollers 26. The pair of trays 22 and 23 are arranged vertically and formed integrally with each other by the pair of side plates 21. The tray 23 is referred to hereinafter as an "upper tray" 23, and the tray 22 as a "lower tray" 22 because the tray 23 is disposed just over the tray 22.

The feed roller 24 is provided to transport a printing plate stored in the lower tray 22 toward the loading transport rollers 25. The pair of loading transport rollers 25 and the pair of unloading transport rollers 26 are disposed to span a distance between the pair of side plates 21. The pair of loading transport rollers 25 in proximity to the forward end of the lower tray 22 are disposed so as to come into contact with each other. The pair of unloading transport rollers 26 in proximity to the forward end of the upper tray 23 are disposed so as to come into contact with each other. The feed roller 24 and the pair of loading transport rollers 25 are coupled by a belt (not shown) to a motor M50 fixed to one of the side plates 21, and are rotated by a driving force generated by the motor M50. The pair of unloading transport rollers 26 are coupled by a belt (not shown) to a motor M54 fixed to the one side plate 21, and are rotated by a driving force generated by the motor M54.

The lower and upper trays 22 and 23 have small holes 27 and 28, respectively, formed therein at predetermined locations. Sensors PH50 and PH54 are fixed just beneath the small holes 27 and 28, respectively, to detect whether or not a printing plate is present just on the small holes 27 and 28.

Figure 3:
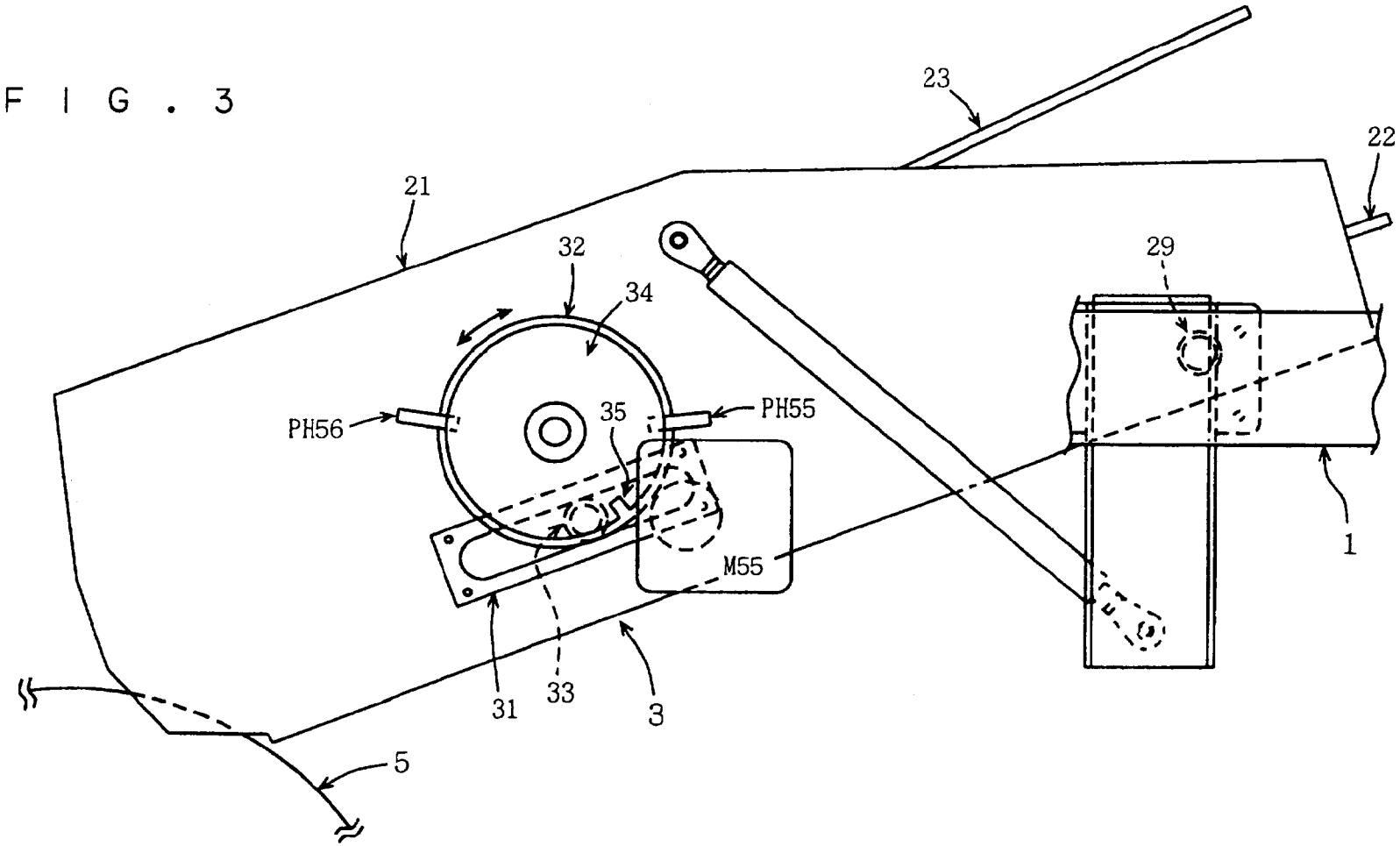
FIG. 3 is a view of a drive mechanism as seen in the direction of the arrow C of FIG. 1.
Figure 4:
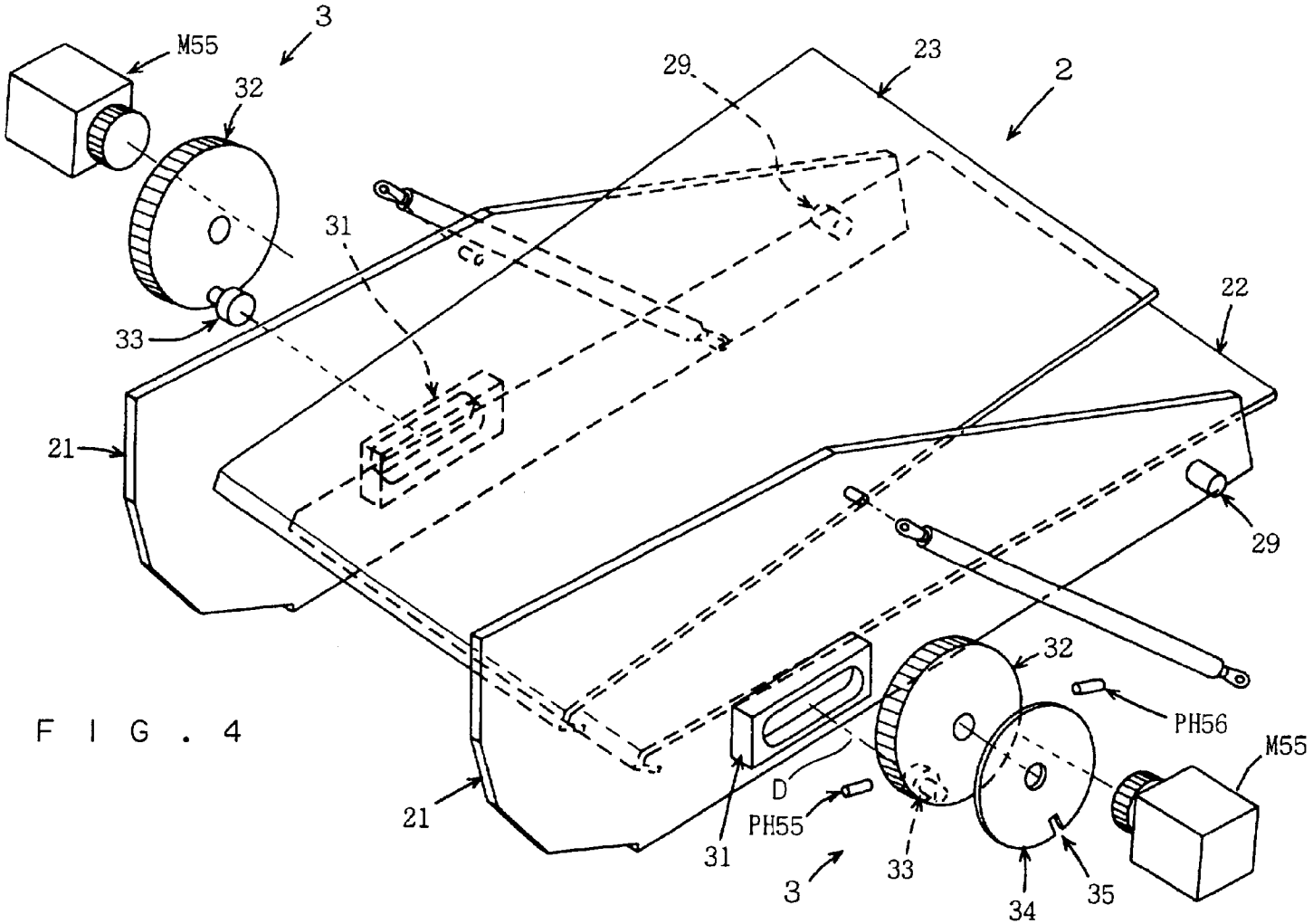
FIG. 4 is an exploded view of the drive mechanism shown in FIG. 3.

The storage/transport mechanism 2 having the above-mentioned construction is secured to a top portion of the frame 1 as indicated by the arrowed dash-dot lines α of FIG. 1. The storage/transport mechanism 2 pivots within a predetermined range about a pivot shaft 29 projecting outwardly from the pair of side plates 21 (as indicated by the arrow β of FIGS. 1 and 2). The drive mechanism 3 accomplishes the pivotal movement of the storage/transport mechanism 2. FIG. 3 is a view of the drive mechanism 3 as seen in the direction of the arrow C of FIG. 1. FIG. 4 is an exploded view of the drive mechanism 3 shown in FIG. 3.

Referring to FIGS. 3 and 4, the drive mechanism 3 comprises a pair of cam follower guides 31, a pair of motors M55, a pair of cam gears 32, a pair of cam followers 33, at least one sensor detection plate 34, at least one sensor PH55, and at least one sensor PH56. Each of the pair of cam follower guides 31 has the outer shape of a rectangular parallelepiped with an oval through hole formed therein. The pair of cam follower guides 31 are fixedly attached to the pair of side plates 21, respectively, so that the through holes of the respective cam follower guides 31 are opposed to each other, with the storage/transport mechanism 2 therebetween (See FIG. 4). The pair of motors M55 are disposed near the respective side plates 21 so as to be opposed to each other, with the storage/transport mechanism 2 therebetween, and are also secured to the frame 1. The pair of cam gears 32 are secured to the frame 1 so as to be opposed to the respective side plates 21. Each of the cam gears 32 receives a driving force generated by a corresponding one of the motors M55 to rotate about its own axis. Each of the cam followers 33 is secured to the outer edge of one of the surfaces (opposed to a corresponding one of the side plates 21) of a corresponding one of the cam gears 32, and makes a circular motion about the axis of the corresponding cam gear 32 as the corresponding cam gear 32 rotates. Each of the cam followers 33 has the shape of a disc with a diameter approximately equal to the vertical width of the through hole of a corresponding one of the cam follower guides 31, and fits into the through hole as indicated by the arrowed dash-dot line D of FIG. 4. Thus, the pair of cam follower guides 31 and the pair of cam gears 32 are coupled to each other by the pair of cam followers 33, respectively, whereby the storage/transport mechanism 2 is supported by the drive mechanism 3.

The sensor detection plate 34 which is disc-shaped is disposed concentrically with a corresponding one of the cam gears 32, and rotates with the corresponding cam gear 32. The sensor detection plate 34 has a single slit 35 in the outer periphery thereof. The sensors PH55 and PH56 are secured to the frame 1 so as to be able to detect the slit 35 formed in the sensor detection plate 34 during the rotation of the sensor detection plate 34.

Figure 5A:
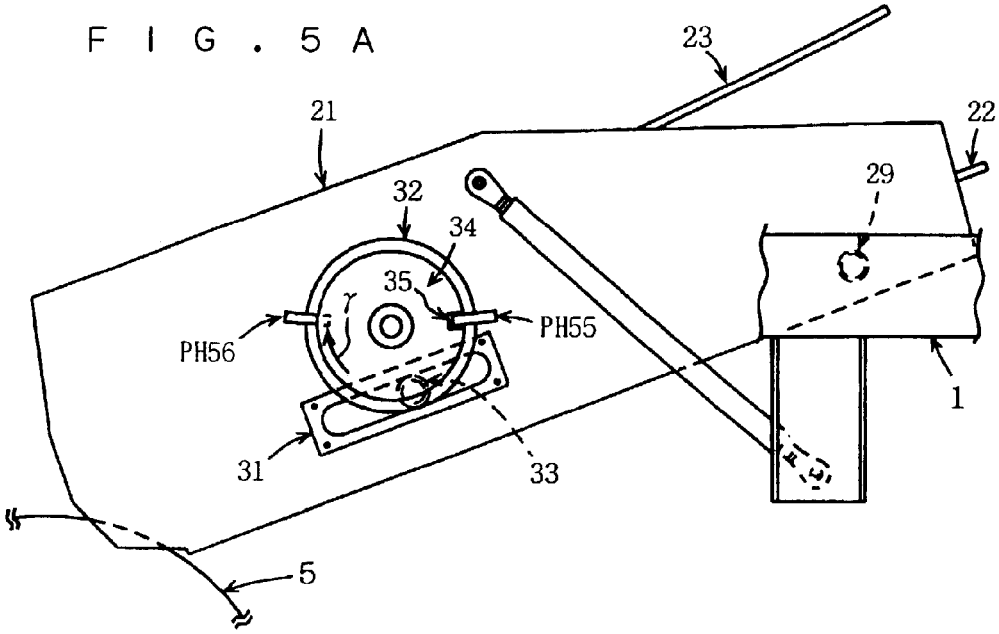
FIGS. 5A and 5B are views for illustrating the operation of the drive mechanism shown in FIGS. 3 and 4.

The operation of the drive mechanism 3 having the above-mentioned construction will be described with reference to FIGS. 5A and 5B. It should be noted that the motors M55 are not shown in FIGS. 5A and 5B for purposes of clarity. Referring to FIG. 5A, the sensor PH55 detects the slit 35 of the sensor detection plate 34 situated immediately adjacent thereto. During the detection, since each of the cam followers 33 is near its lowermost position within the range of the circular motion thereof, the storage/transport mechanism 2 is supported at a position (referred to hereinafter as a lowered position) corresponding to the lowermost position by the drive mechanism 3. Then, as the pair of cam gears 32 receive the driving force generated by the respective motors M55 to start rotating in a direction indicated by the arrow γ, the cam followers 33 start the circular motion in the same direction, that is, in an upward direction from the current lowermost position. Thus, the cam followers 33 move the storage/transport mechanism 2 to which the cam follower guides 31 are secured in an upward direction from the lowered position.

Figure 5B:
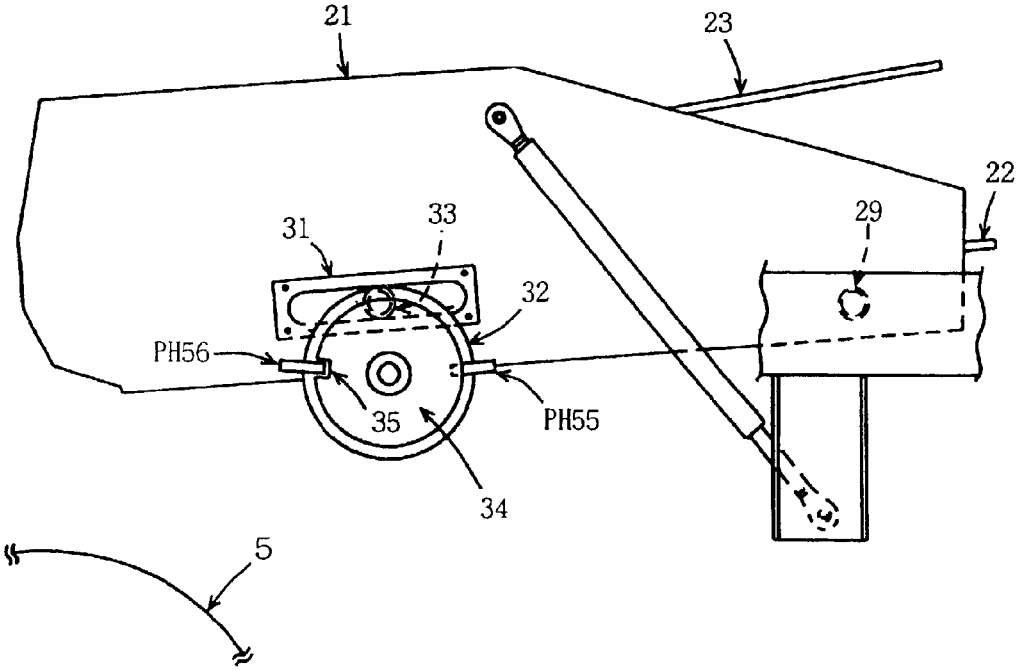

Referring to FIG. 5B, with the rotation of the cam gears 32, the slit 35 of the sensor detection plate 34 makes a circular motion in the direction indicated by the arrow γ from the position immediately adjacent to the sensor PH55 until it reaches a position immediately adjacent to the sensor PH56. The sensor PH56 detects the slit 35 situated immediately adjacent thereto. At the detection, the motors M55 stop generating the driving force. Thus, each of the cam followers 33 is near its uppermost position within the range of the circular motion thereof, and the storage/transport mechanism 2 is supported and stopped at a position (referred to hereinafter as a raised position) corresponding to the uppermost position by the drive mechanism 3. The above-mentioned operation and its reverse operation of the drive mechanism 3 cause the storage/transport mechanism 2 to pivot substantially up and down about the pivot shaft 29 between the lowered position and the raised position.

Next, the punch unit 4 shown in FIG. 1 will be described. The punch unit 4 comprises a mounting member 42, and first to fifth punchers 41*a* to 41*e*. The punchers 41*a* to 41*e* have respective functions to be described below. The puncher 41*a* is a member for forming in a printing plate P a notch 44*ae* for positioning the printing plate P on the recording drum 5, and the punchers 41*b* and 41*c* are members for forming escape notches 44*be* and 44*ce* in the printing plate P. The punchers 41*d* and 41*e* are members for forming in the printing plate P punched holes 44*de* and 44*ee* serving as a reference during the positioning of the image-recorded printing plate P in the printing apparatus.

Figure 6:
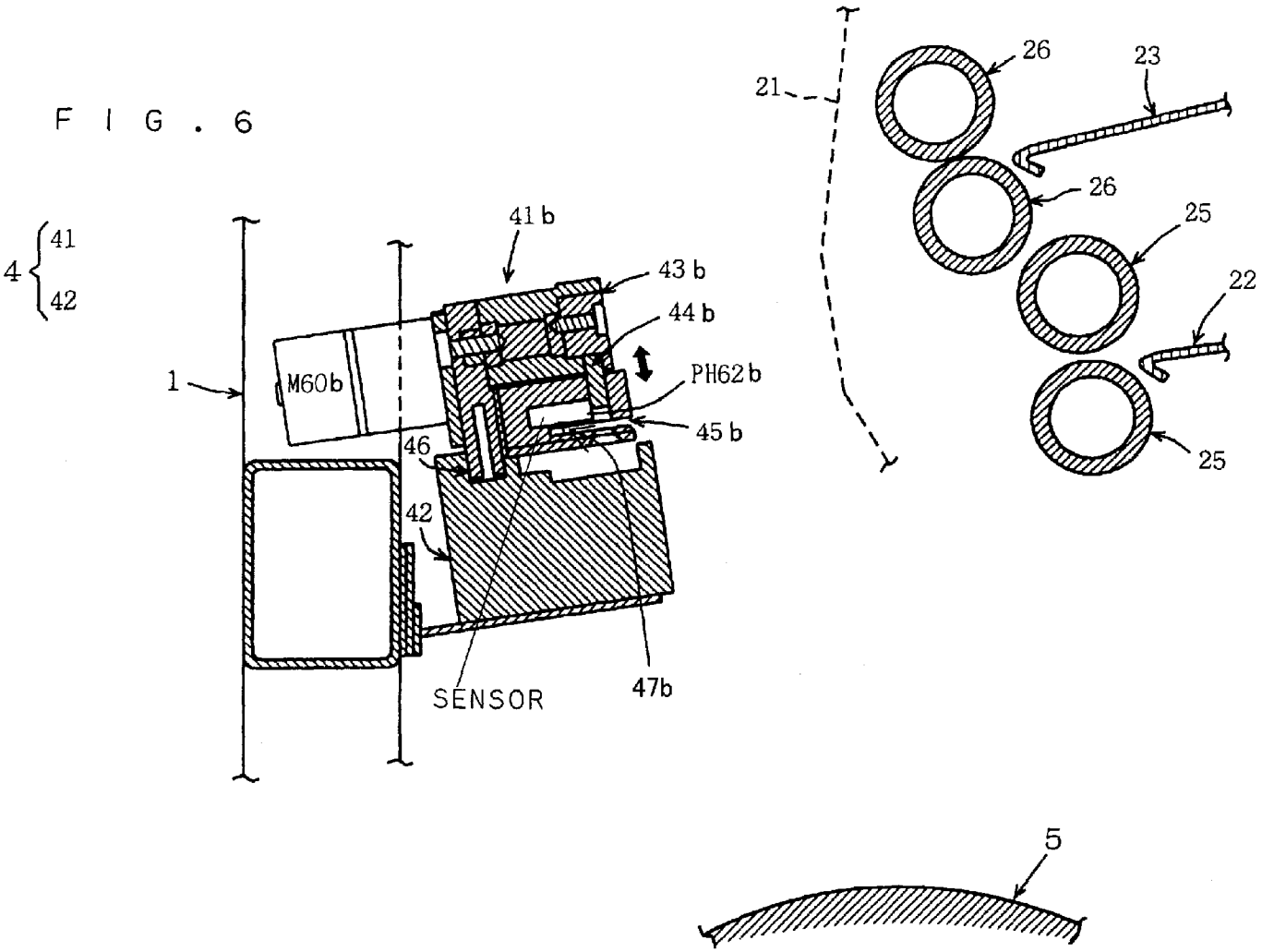
FIG. 6 is a sectional view of a punch unit taken along the dash-dot line E–E' of FIG. 1 as seen in the direction of the arrow F.

FIG. 6 is a sectional view of the punch unit 4 taken along the dash-dot line E–E' of FIG. 1 as seen in the direction of the arrow F. Although the punch unit 4 has the five punchers 41*a* to 41*e* as discussed above, the section of the second puncher 41*b* is shown in FIG. 6. The puncher 41*b* generally comprises a main body 43*b*, a sensor PH62*b*, a motor M60*b*, a punch 44*b*, and a reference pin 47*b*. The main body 43*b* has a clearance 45*b* for receiving the printing plate P transported along a first feed path line. The reference pin 47*b* is provided in the clearance 45*b*, and the printing plate P is positioned by bringing the leading edge of the printing plate P inserted in the clearance 45*b* into contact with the reference pin 47*b*. The sensor PH62*b* detects whether or not the printing plate P is inserted in the clearance 45*b*. The motor M60*b* generates a driving force when the sensor PH62*b* detects the printing plate P. This driving force is converted into a force for moving the punch 44*b* up and down by a cam mechanism (not shown) provided in the main body 43*b*. The punch 44*b* receives the force transmitted from the cam mechanism to move up and down, thereby punching the printing plate P placed in the clearance 45*b*. This provides a notch in one of the edges of the printing plate P.

The above discussion holds true for the third puncher 41*c*. The first puncher 41*a* differs from the second and third punchers 41*b* and 41*c* in the sectional configuration of the punch. The fourth and fifth punchers 41*d* and 41*e* differ from the second and third punchers 41*b* and 41*c* in the sectional configuration of the punch and in having no reference pins. Except for these differences, the first, fourth and fifth punchers 41*a*, 41*d* and 41*e* are substantially similar in mechanism to the second puncher 41*b*.

The first to fifth punchers 41*a* to 41*e* comprise respective punches 44*a* to 44*e* having a sectional configuration to be described below. The punch 44*a* of the first puncher 41*a* is of a perfectly circular sectional configuration with a radius r. The punches 44*b* and 44*c* of the second and third punchers 41*b* and 41*c* are of a substantially C-shaped sectional configuration. The punches 44*d* and 44*e* of the fourth and fifth punchers 41*d* and 41*e* are of a rectangular sectional configuration.

Figure 7:
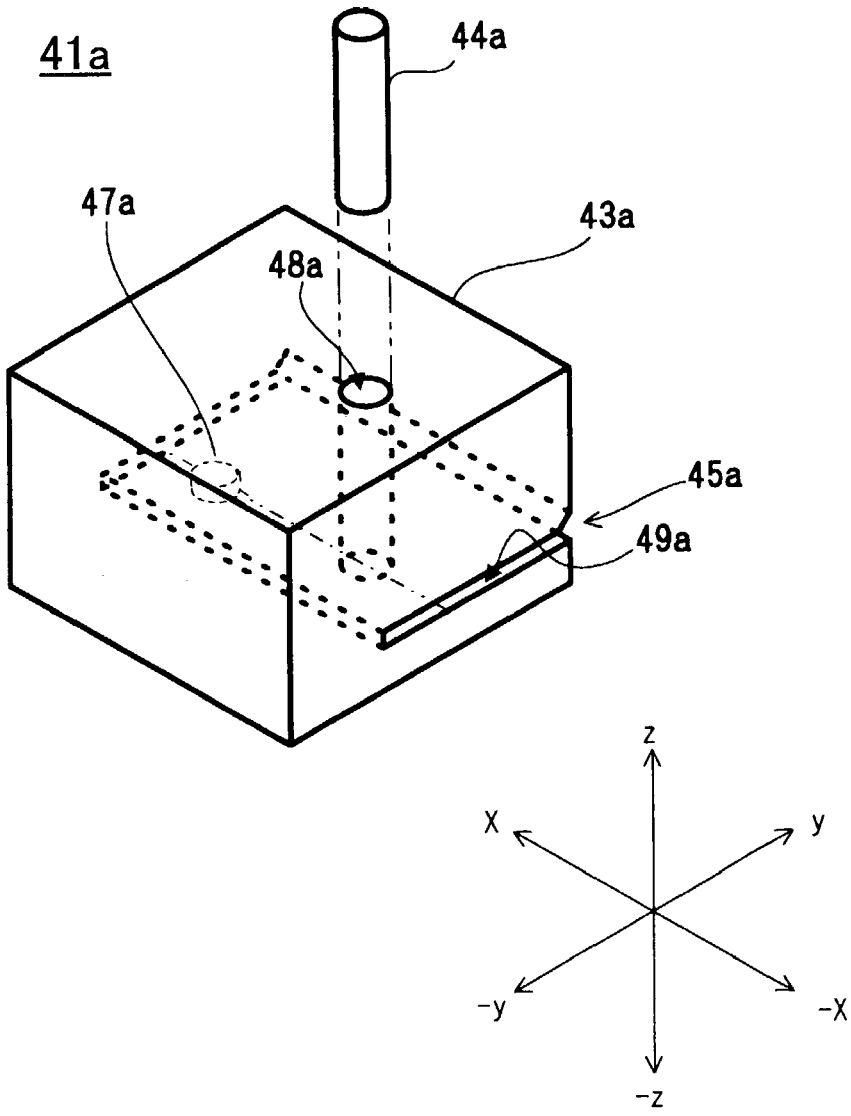
FIG. 7 is a partial perspective view of a first puncher.

FIG. 7 is a perspective view of principal parts of the first puncher 41*a*. As shown in FIG. 7, the puncher 41*a* comprises a main body 43*a* having a through hole 48*a* formed therein for receiving the punch 44*a* moving up and down. The through hole 48*a* extends from the upper surface of the main body 43*a* to a clearance 45*a*. The punch 44*a* is deviated from the center of the main body 43*a* in the −x direction, as seen from above (See FIG. 20A). A reference pin 47*a* is provided on a flat surface 49*a* inside the main body 43*a*, and is deviated from the center of the main body 43*a* in the +x direction opposite from the punch 44*a*, as seen from above. The punch 44*a* has a perfectly circular sectional configuration, as described above, and a line extending in the x direction along the diameter of the section of the punch 44*a* coincides with a tangent to the reference pin 47*a*.

The sectional configuration of the punch 44*b* and the mounting location of the reference pin 47*b* in the second puncher 41*b* will be illustrated with reference to FIG. 8.

Figure 8:
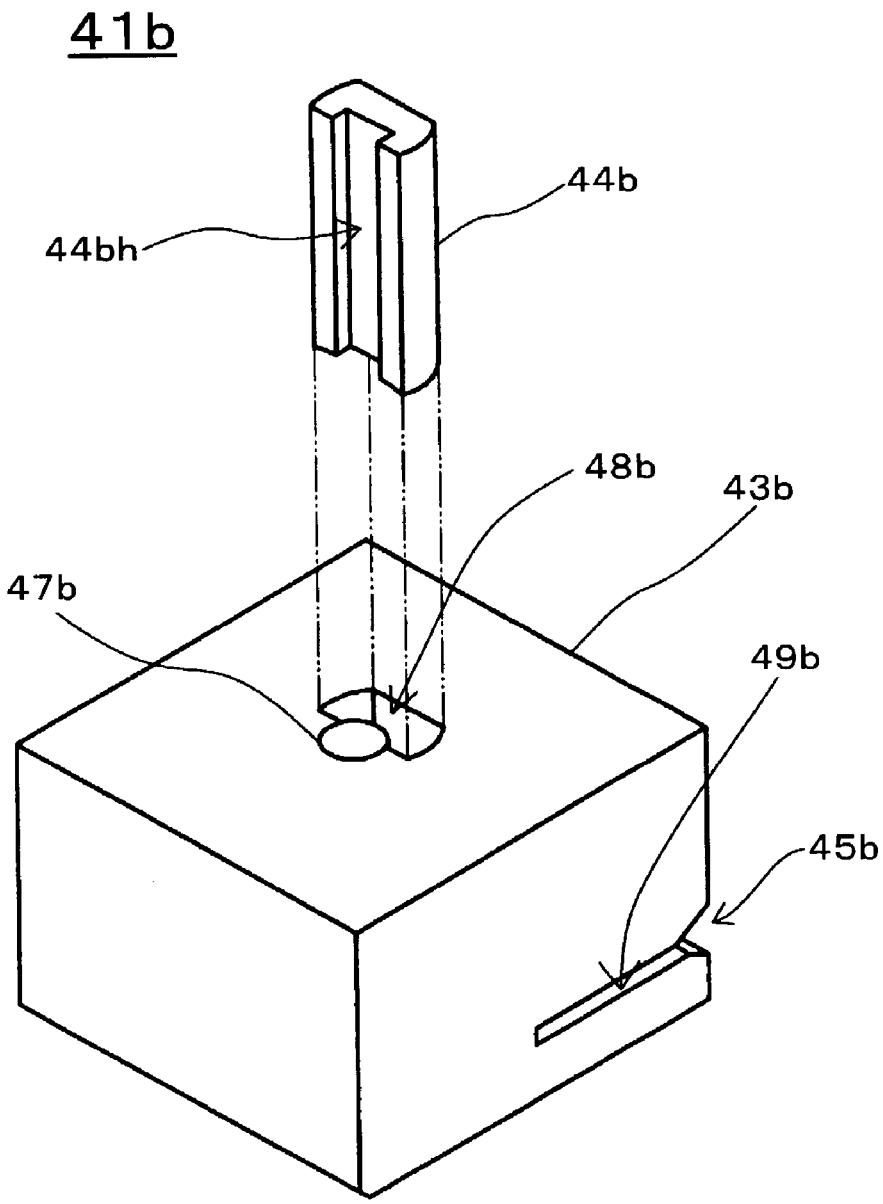
FIG. 8 is a partial perspective view of a second puncher.

FIG. 8 is a perspective view of principal parts of the second puncher 41*b*. As shown in FIG. 8, the main body 43*b* of the puncher 41*b* has a through hole 48*b* formed therein. The through hole 48*b* extends from the upper surface of the main body 43*b* to the clearance 45*b* The reference pin 47*b* is buried and fixed in part of the through hole 48*b*. The bottom end of the reference pin 47*b* reaches a flat surface 49*b*.

The punch 44*b* moves up and down through a space of the through hole 48*b* not occupied by the reference pin 47*b*. A recess 44*bh* is formed in one side surface of the punch 44*b* to prevent the punch 44*b* from contacting the reference pin 47*b*. It is desirable that a spacing between the recess 44*bh* and the reference pin 47*b* is very small.

Figure 9:
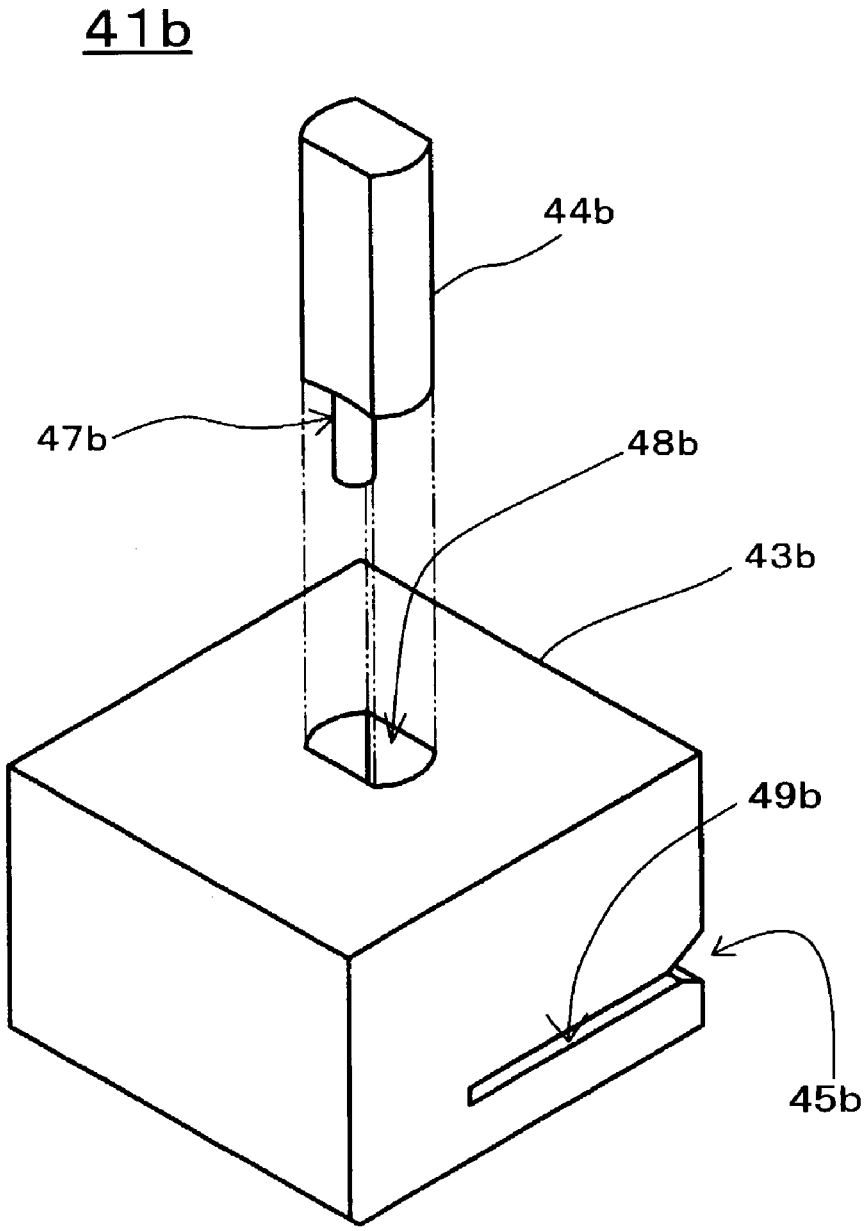
FIG. 9 is a partial perspective view of a variation of the second puncher.

Another usable form of the second puncher 41*b* is shown in FIG. 9.

In this example, the reference pin 47*b* is attached to a tip of the punch 44*b* and moves up and down with the punch 44*b*. The flat surface 49*b* has a recess not shown so that the reference pin 47*b* can escape to below the flat surface 49*b* when the punch 44*b* moves down. In this example, the reference pin 47*b* or the punch 44*b* may be selectively situated in the clearance 45*b* by adjusting the vertical location of the punch 44*b*.

Referring again to FIG. 6, the mounting member 42 of the punch unit 4 has approximately the outer shape of a rectangular parallelepiped with a longitudinal groove 46 formed therein. The punchers 41*a* to 41*e* are mounted in the groove 46. The mounting member 42 may be formed with knocked holes, bolt holes and the like, rather than the groove 46, to secure the punchers 41*a* to 41*e*. The above-mentioned punch unit 4 is secured onto the frame 1 as indicated by the arrowed dash-dot lines δ of FIG. 1.

Figure 10:
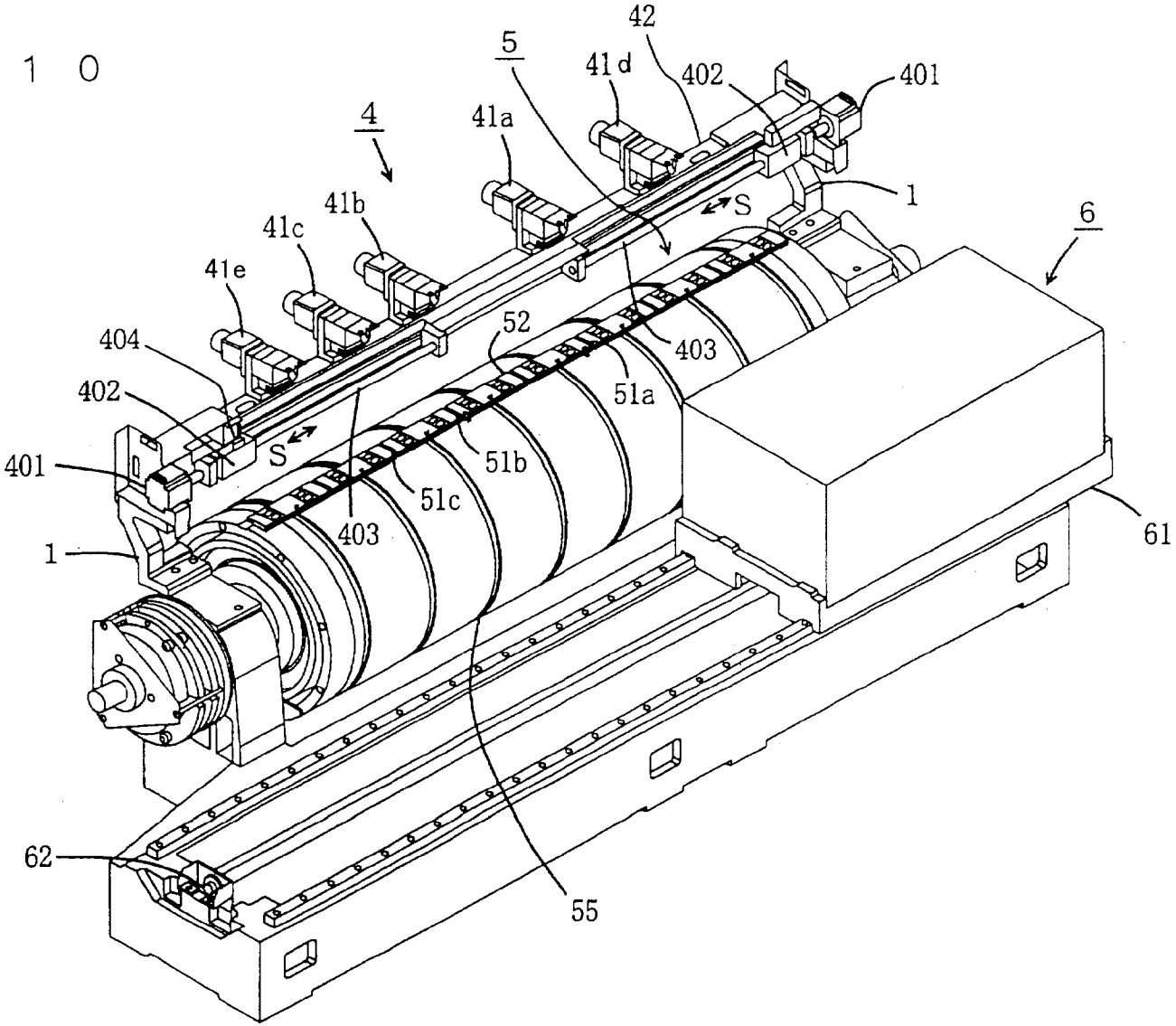
FIG. 10 is a perspective view showing the punch unit, a recording drum and their surrounding components shown in FIG. 1.

FIG. 10 is a perspective view showing the punch unit 4, the recording drum 5 and the exposure head 6 which are secured on the frame 1 in a manner described above. The storage/transport mechanism 2, the drive mechanism 3 and the electrical component 7 are not shown in FIG. 10 for purposes of clarity.

With reference to FIG. 10, the five punchers 41*a* to 41*e* are secured to the mounting member 42. The puncher 41*a* is used to form a notch indicating a reference position, and the punchers 41*b* and 41*c* are used to form escape notches. The punchers 41*d* and 41*e* are used to form punched holes for positioning the printing plate P in the printing apparatus. A pair of centering motors 401 are secured respectively to opposite ends of the front surface of the mounting member 42. The centering motors 401 rotatably drive a pair of rotatable ball screws 403 extending horizontally along the front surface of the mounting member 42. The ball screws 403 are in threaded engagement with centering bearings 402, respectively. A pair of rotatable holding portions 404 of a cylindrical shape (although only one holding portion 404 is shown in FIG. 10) are provided on the upper surface of the respective centering bearings 402. Rotation of the centering motors 401 causes the centering bearings 402 to move in a direction indicated by the arrows S of FIG. 10.

When the printing plate P is introduced to the punch unit 4, the printing plate P is placed between the pair of centering bearings 402. The centering motors 401 are rotated to move the pair of centering bearings 402 from their predetermined original locations toward the center of the mounting member 42, whereby the outer peripheral surfaces of the holding portions 404 of the centering bearings 402 come into contact with opposite edges, respectively, of the printing plate P which are perpendicular to the leading edge thereof. Thus, the printing plate P is positioned centrally of the mounting member 42. The centering motors 401, the centering bearings 402, the ball screws 403, and the holding portions 404 are collectively referred to hereinafter as a centering mechanism.

Figure 11:
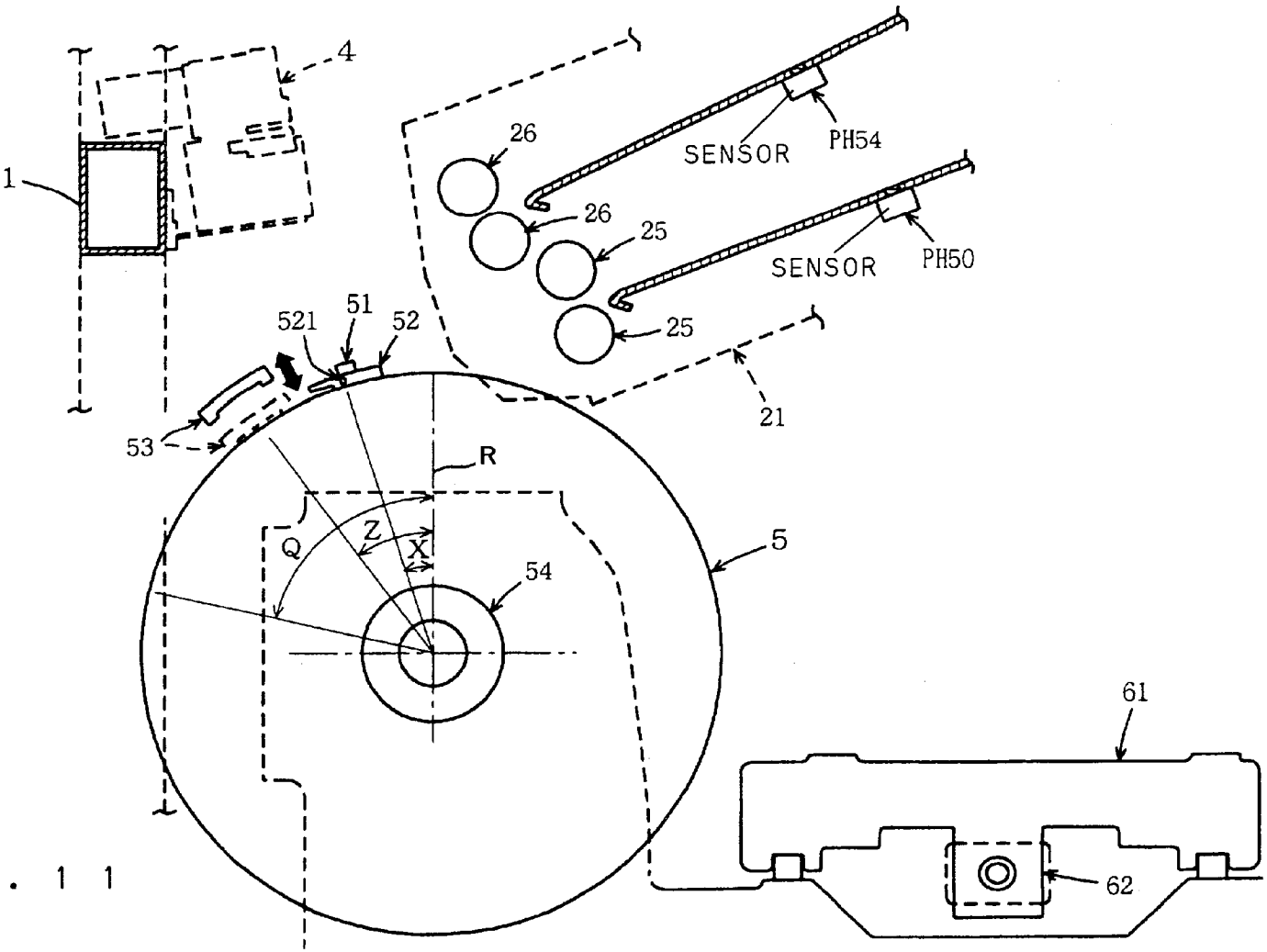
FIG. 11 is a sectional view of the recording drum and its surrounding components taken along the dash-dot line G–G' of FIG. 1 as seen in the direction of the arrow H.

The recording drum 5 shown in FIGS. 1 and 10 will be described. FIG. 11 is a sectional view of the recording drum 5 and its surrounding components taken along the dash-dot line G–G' of FIG. 1 as seen in the direction of the arrow H. Referring to FIGS. 1, 10 and 11, the recording drum 5 is disposed in the frame 1 in a location angularly downwardly of the storage/transport mechanism 2 and the punch unit 4. The recording drum 5 has a substantially cylindrical shape, and receives the driving force generated by a motor M1 (shown in FIG. 1) to rotate about the axis of the cylinder thereof. The printing plate P (indicated as a shaded portion in FIG. 1) transported along a second feed path line (to be described later) is wound and mounted around the outer surface (annular surface) of the recording drum 5.

To secure the printing plate P on the outer surface of the recording drum 5, the image recorder according to the present invention comprises at least three positioning pins 51*a*, 51*b*, 51*c* (generically referred to as positioning pins 51), leading edge clamps 52, and trailing edge clamps 53. The positioning pins 51 are fixed on the outer surface of the recording drum 5 (the specific location of the positioning pins 51 will be described later). The leading edge clamps 52 are capable of clamping the leading edge of the printing plate P transported along the second feed path line (to be described later), with the positioning pin 51*a* fitted in the notch formed in the printing plate P by the puncher 41*a*. The trailing edge clamps 53 are detachable from the outer surface of the recording drum 5. The trailing edge clamps 53 are held by a third clamp driver not shown when detached from the recording drum 5, and clamp the trailing edge of the printing plate P transported along the second feed path line (to be described later) when attached to the recording drum 5.

A rotary encoder 54 is mounted to the rotary shaft of the recording drum 5 to detect various angular positions. In the image recorder according to the present invention, three angular positions are previously determined: a first angular position X in which the leading edge clamps 52 clamp the printing plate P, a second angular position Z associated with a location in which the trailing edge clamps 53 are attached, and a third angular position Q in which the leading edge clamps 52 unclamp the printing plate P. These angular positions X, Z and Q are determined with respect to a previously determined reference line R, as shown in FIG. 11. When in the first angular position X, the leading edge clamps 52 are driven by a first clamp driver not shown to clamp the leading edge of the printing plate P. When in the third angular position Q, the leading edge clamps 52 are driven by a second clamp driver not shown to unclamp the leading edge of the printing plate P. The trailing edge clamps 53, when in the second angular position Z, are attached to the outer surface of the recording drum 5 by the third clamp driver not shown to clamp the trailing edge of the printing plate P. The trailing edge clamps 53 attached to the outer surface of the recording drum 5 are detached from the outer surface of the recording drum 5 by the third clamp driver to release the trailing edge of the printing plate P, when also in the second angular position Z. Since the first to third clamp drivers themselves form no part of the present invention, they will not be described in detail herein.

For intimate contact of the printing plate P with the outer surface of the recording drum 5, the image recorder according to the present invention comprises: a plurality of small holes and grooves (referred to hereinafter as suction holes and suction grooves 55) formed in the outer surface of the recording drum 5 to hold the printing plate P by vacuum suction; a blower (not shown), in conjunction with the suction holes and suction grooves 55, constitutes a vacuum system; and a squeeze roller (not shown) disposed near the recording drum 5. Since the suction holes and suction grooves 55, the blower, and the squeeze roller are not relevant to the intent of the present invention, they will not be described in detail herein.

Next, the exposure head 6 will be described. As indicated by the dash-dot lines $\epsilon$ of FIG. 1 and shown in FIG. 11, the exposure head 6 is placed on a table 61 disposed in proximity to the recording drum 5. While being fed in a direction parallel to the axis of rotation of the recording drum 5 by the driving force generated by a feed screw mechanism 62, the exposure head 6 scans the printing plate P rotating with the recording drum 5 with optical beams modulated based on image data given from the electrical component 7 to be described later, thereby to carry out exposure.

The electrical component 7 is mounted to a side portion of the frame 1, as indicated by the arrowed dash-dot lines $\zeta$ of FIG. 1. The electrical component 7 is electrically connected to the above-mentioned components of the image recorder, and controls the operations of the image recorder while sending and receiving signals to and from the components.

Next, description will be given on the operations of the storage/transport mechanism 2 and the printing plate P. FIGS. 12 through 19 are schematic sectional side views showing the operations of the storage/transport mechanism 2 and the printing plate P. The operations of the storage/transport mechanism 2 and the printing plate P will be described with reference to FIGS. 12 through 19.

Figure 12:
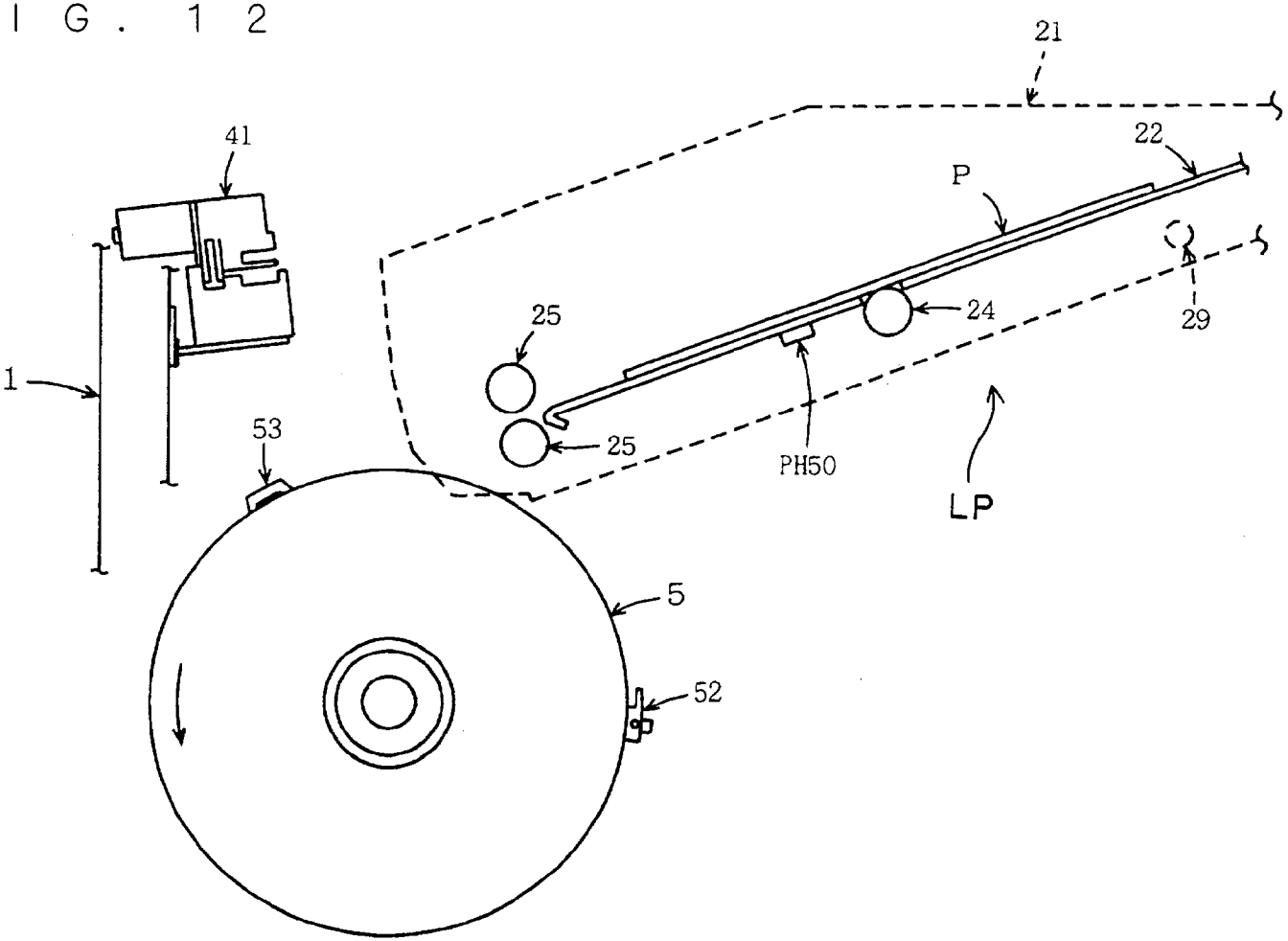
FIG. 12 a view showing a printing plate fed to a lower tray of the storage/transport mechanism.
Figure 13:
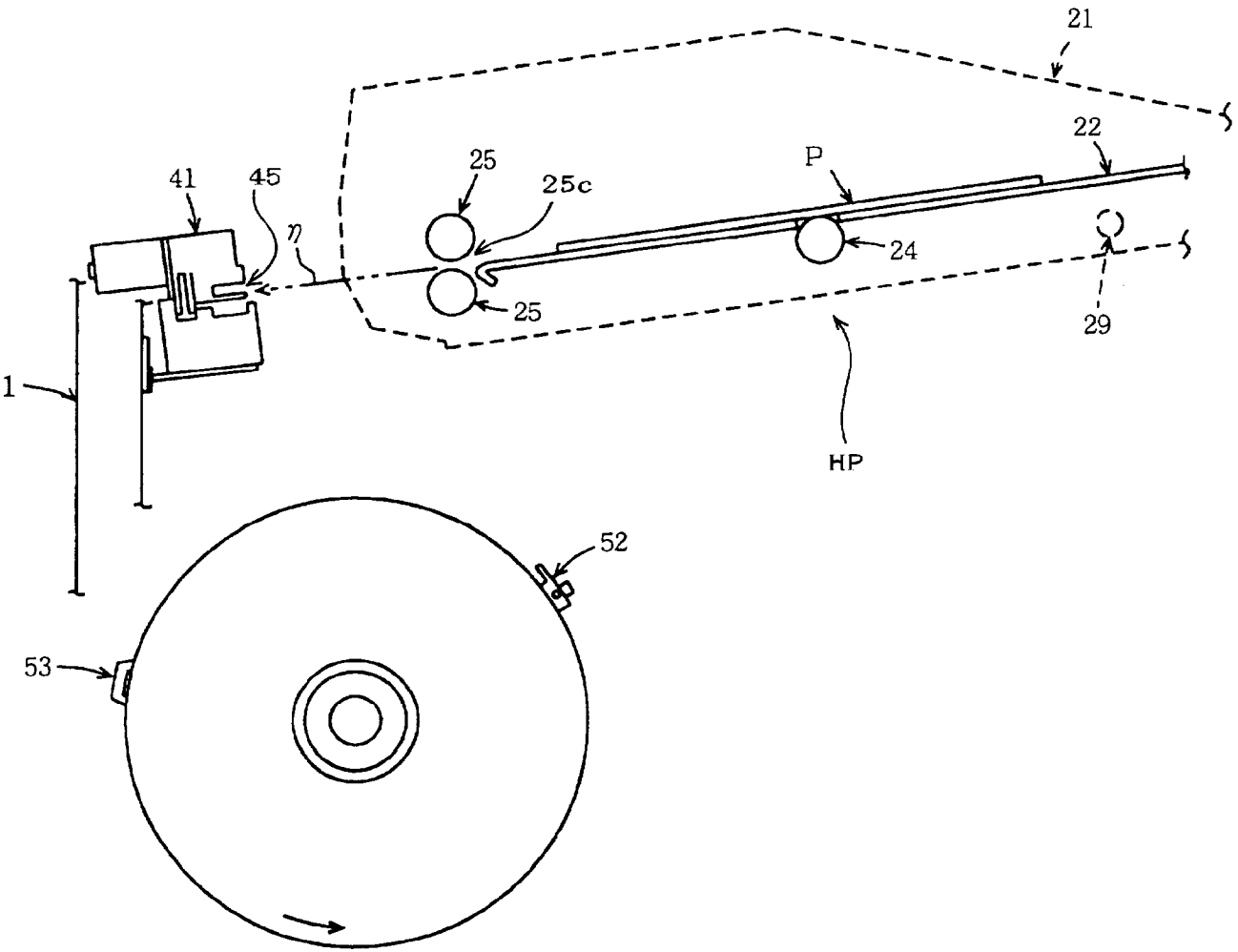
FIG. 13 is a view for illustrating a first feed path line.

First, the printing plate P to be punched is fed to the lower tray 22 of the storage/transport mechanism 2, as illustrated in FIG. 12. The printing plate P is fed to the lower tray 22, for example, manually by an operator or automatically by an automatic printing plate feed mechanism (not shown) additionally mounted to the image recorder according to the present invention. Upon detection of the printing plate P fed to the lower tray 22, the sensor PH50 of the storage/transport mechanism 2 outputs a detection signal so indicating to the electrical component 7. To commence a punching process step on the printing plate P received in the lower tray 22, the electrical component 7 drives the motors M55 in response to the detection signal applied thereto. The drive mechanism 3 receives the driving force of the motors M55 to move the storage/transport mechanism 2 from the lowered position LP shown in FIG. 12 to the raised position HP shown in FIG. 13. This causes a clearance 25*c* between the pair of loading transport rollers 25 of the storage/transport mechanism 2 to be in line with a clearance 45 (which is a generic designation of the clearances 45*a* to 45*e*) of the punch unit 4. Thus, the first feed path line as indicated by the arrowed dash-double-dot line $\eta$ of FIG. 13 is formed between the clearances 25*c* and 45.

Figure 14:
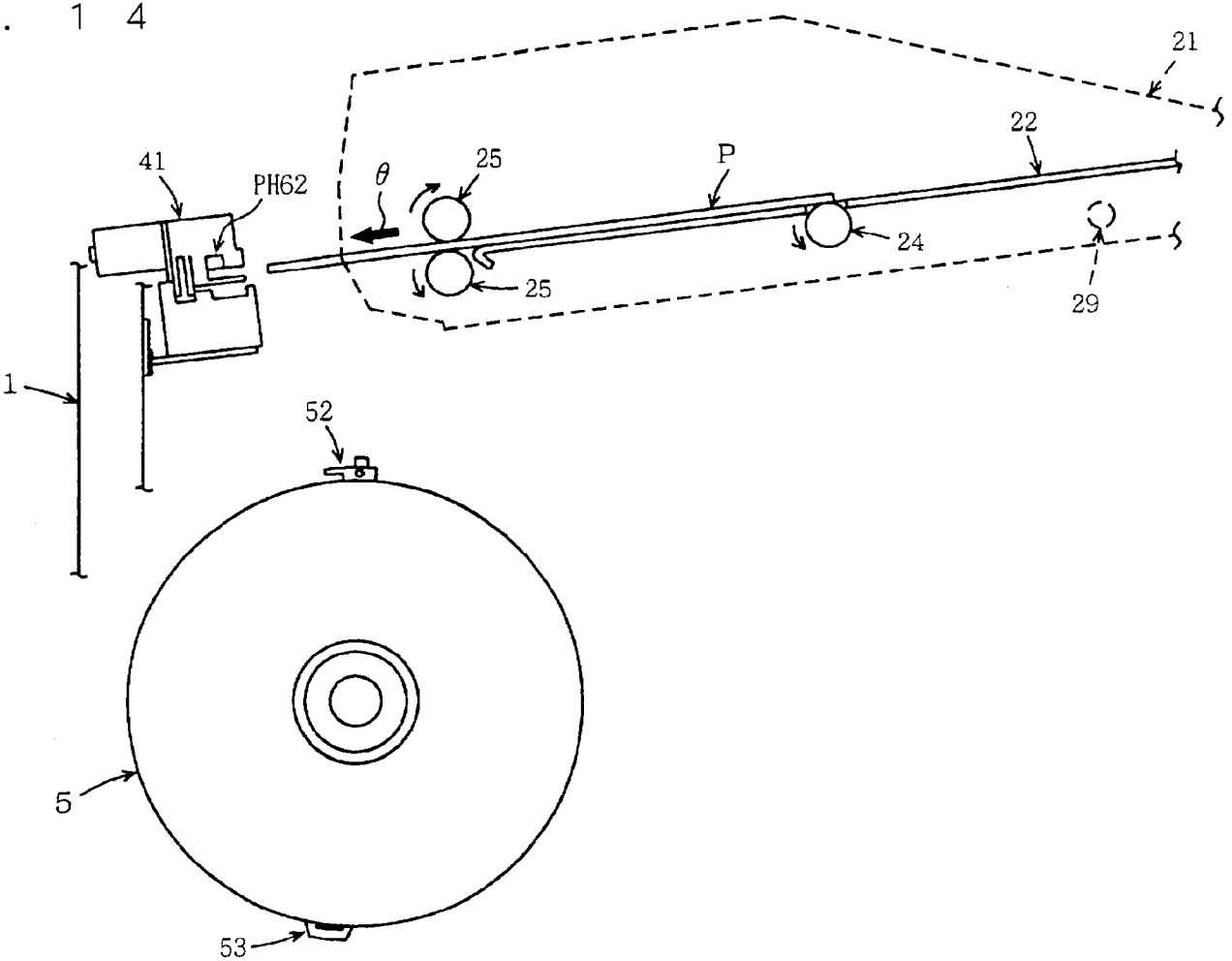
FIG. 14 is a view showing the positive rotation of a feed roller and transport rollers.

After the first feed path line is formed, the electrical component 7 drives the motor M50. Upon receipt of the driving force of the motor M50, the feed roller 24 and the transport rollers 25 rotate in such a direction as to feed the printing plate P from the storage/transport mechanism 2 toward the punch unit 4 (as indicated by the arrow $\theta$), as shown in FIG. 14. This rotation of the feed roller 24 and the transport rollers 25 is referred to hereinafter as positive rotation. Thus, the printing plate P is fed along the surface of the lower tray 22 toward the transport rollers 25 by the rotation of the feed roller 24, and is then fed outwardly into the first feed path line by the transport rollers 25, with the leading edge of the printing plate P placed forward. The printing plate P fed out is transported linearly along the first feed path line. At some midpoint of the first feed path line, the above-mentioned centering mechanism adjusts the position of the printing plate P with respect to the punchers 41*a* to 41*e* (collectively referred to as a puncher 41). The printing plate P subjected to the position adjustment is then introduced into the clearance 45 of the puncher 41. The printing plate P introduced into the clearance 45 of the puncher 41 is subjected to the punching process for forming notches and punched holes according to a procedure to be described later.

Figure 15:
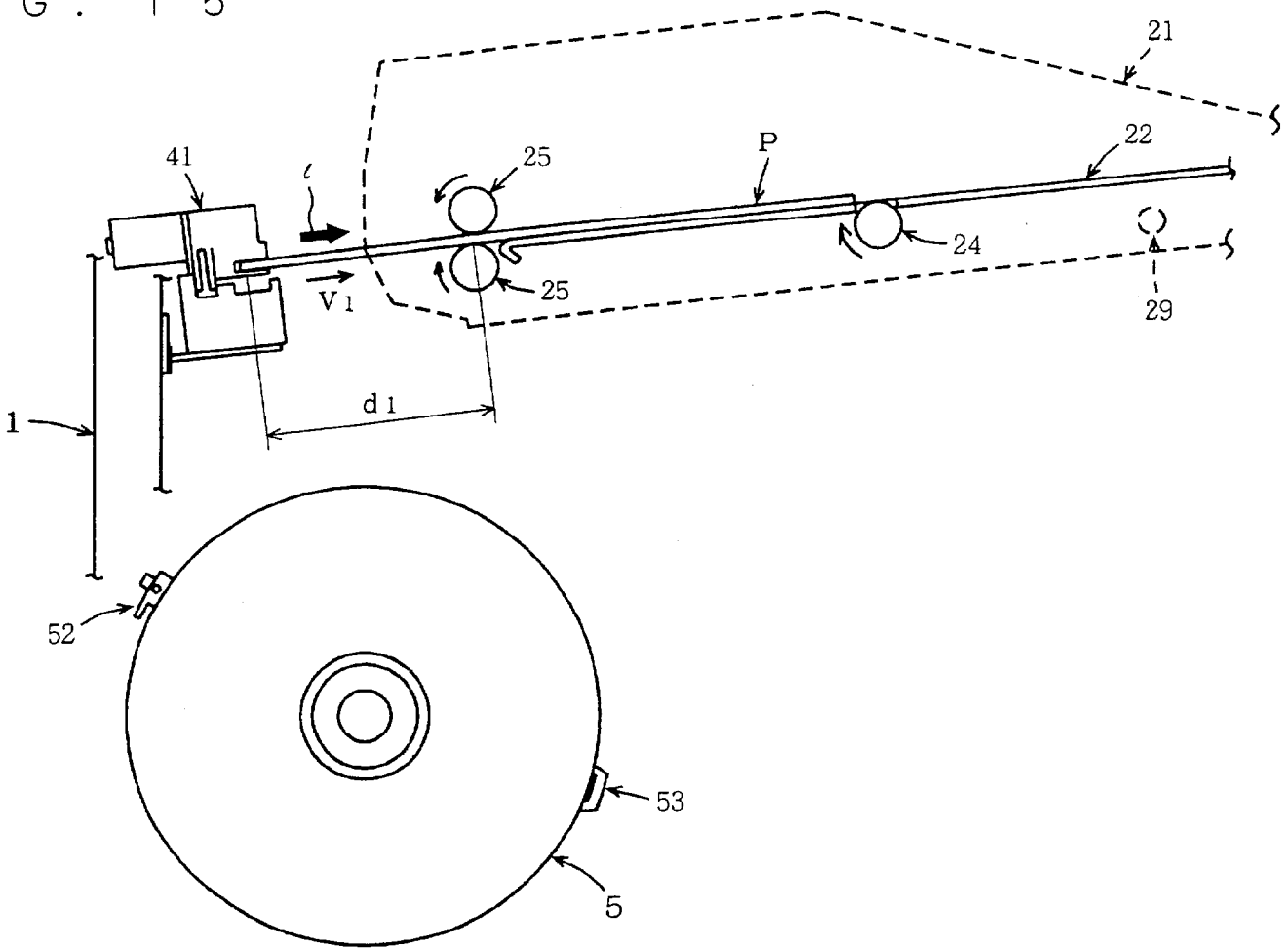
FIG. 15 is a view showing the negative rotation of the feed roller and the transport rollers.

After the punching process, the electrical component 7 drives the motor M50. Upon receipt of the driving force of the motor M50, the feed roller 24 and the transport rollers 25 rotate at a substantially constant speed in such a direction as to draw the punched printing plate P out of the punch unit 4 toward the storage/transport mechanism 2 (as indicated by the arrow ι), as shown in FIG. 15. This rotation of the feed roller 24 and the transport rollers 25 is referred to hereinafter as negative rotation. By the negative rotation of the feed roller 24 and the transport rollers 25, the punched printing plate P is fed backwardly along the first feed path line and received again onto the lower tray 22.

Figure 16:
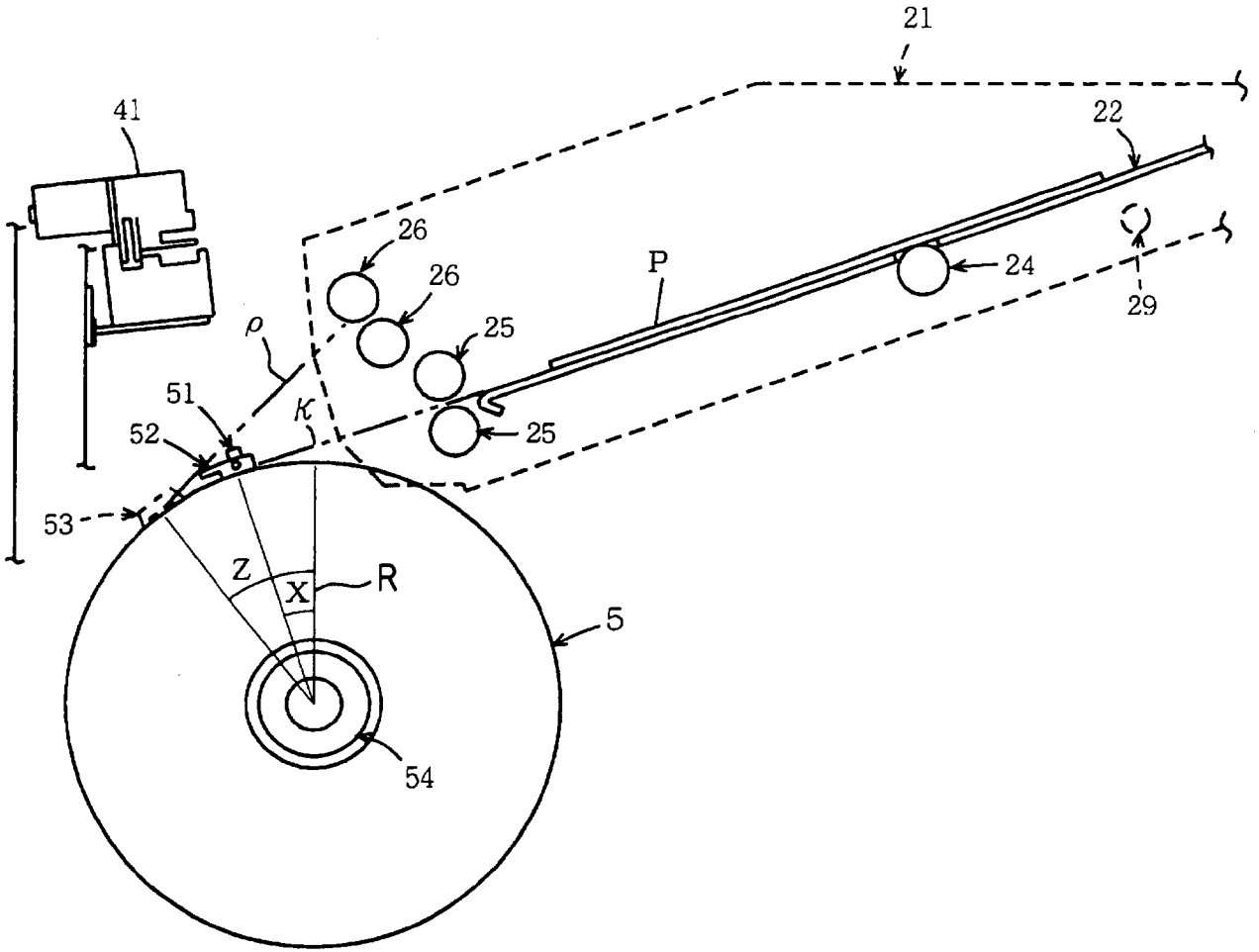
FIG. 16 is a view for illustrating a first angular position of a leading edge clamp.

Next, the electrical component 7 stops driving he motor M50, and drives the motors M55 instead. The drive mechanism 3 receives the driving force of the motors M55 to move the storage/transport mechanism 2 from the raised position HP to the lowered position LP, and stops moving the storage/transport mechanism 2 in the lowered position, as shown in FIG. 16. Thus, the storage/transport mechanism 2 and the recording drum 5 are opposed to each other. Subsequently, the loading of the printing plate P being currently held in the lower tray 22 is carried out.

The electrical component 7 drives the motor M1 to rotate the recording drum 5 until the leading edge clamps 52 reach the first angular position X. When the leading edge clamps 52 are in the first angular position X, the storage/transport mechanism 2 and the recording drum 5 are disposed so that a line connecting the clearance 25*c* between the pair of loading transport rollers 25 and the leading edge clamps 52 contacts (or intersects) the outer surface of the recording drum 5. In other words, the point of contact (or intersection) between such a line and the outer surface is defined as the first angular position X. At this time, the second feed path line is determined which is indicated by the dash-double-dot line κ of FIG. 16 connecting the clearance 25*c* between the pair of loading transport rollers 25 and the leading edge clamps 52 situated in the first angular position X.

Figure 17:
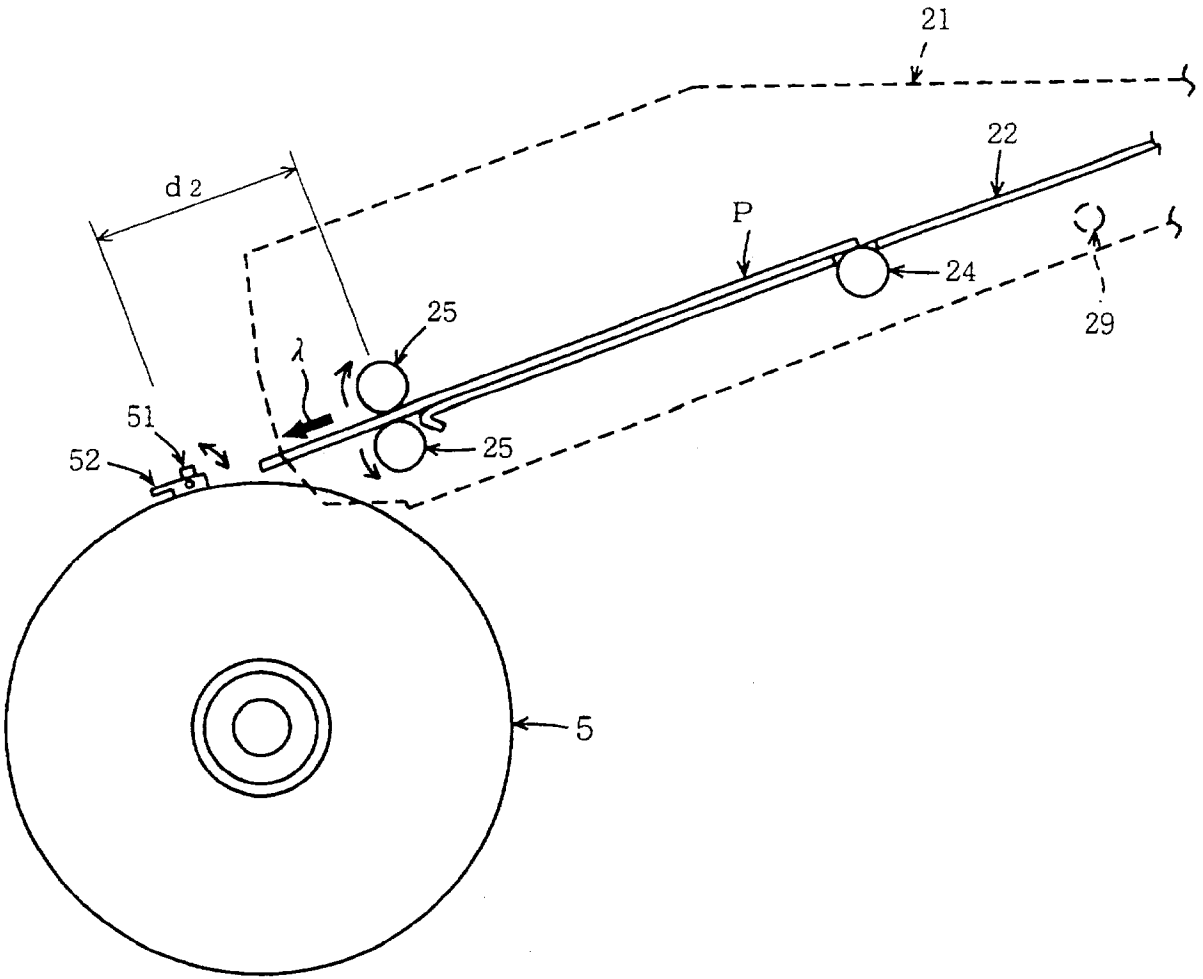
FIG. 17 is a view showing the feed roller and the transport rollers making the positive rotation during the loading of the printing plate.

Then, the electrical component 7 drives the motor M50. This causes the feed roller 24 and the transport rollers 25 to make the positive rotation in the above-mentioned manner to feed the printing plate P outwardly (as indicated by the arrow λ) from the lower tray 22 along the second feed path line toward the recording drum 5, as shown in FIG. 17. The printing plate P fed out is positioned with respect to the recording drum 5 by the engagement of a notch formed in the leading edge thereof with the positioning pin 51*a*.

After the leading edge of the printing plate P is positioned with respect to the recording drum 5, the electrical component 7 drives the leading edge clamps 52 by means of the first clamp driver to clamp the leading edge of the printing plate P. Thereafter, the electrical component 7 drives the motor Ml to rotate the recording drum 5 in a direction indicated by the arrow μ of FIG. 18. The rotation of the recording drum 5 in the direction indicated by the arrow μ is referred to hereinafter as positive rotation.

Figure 18:
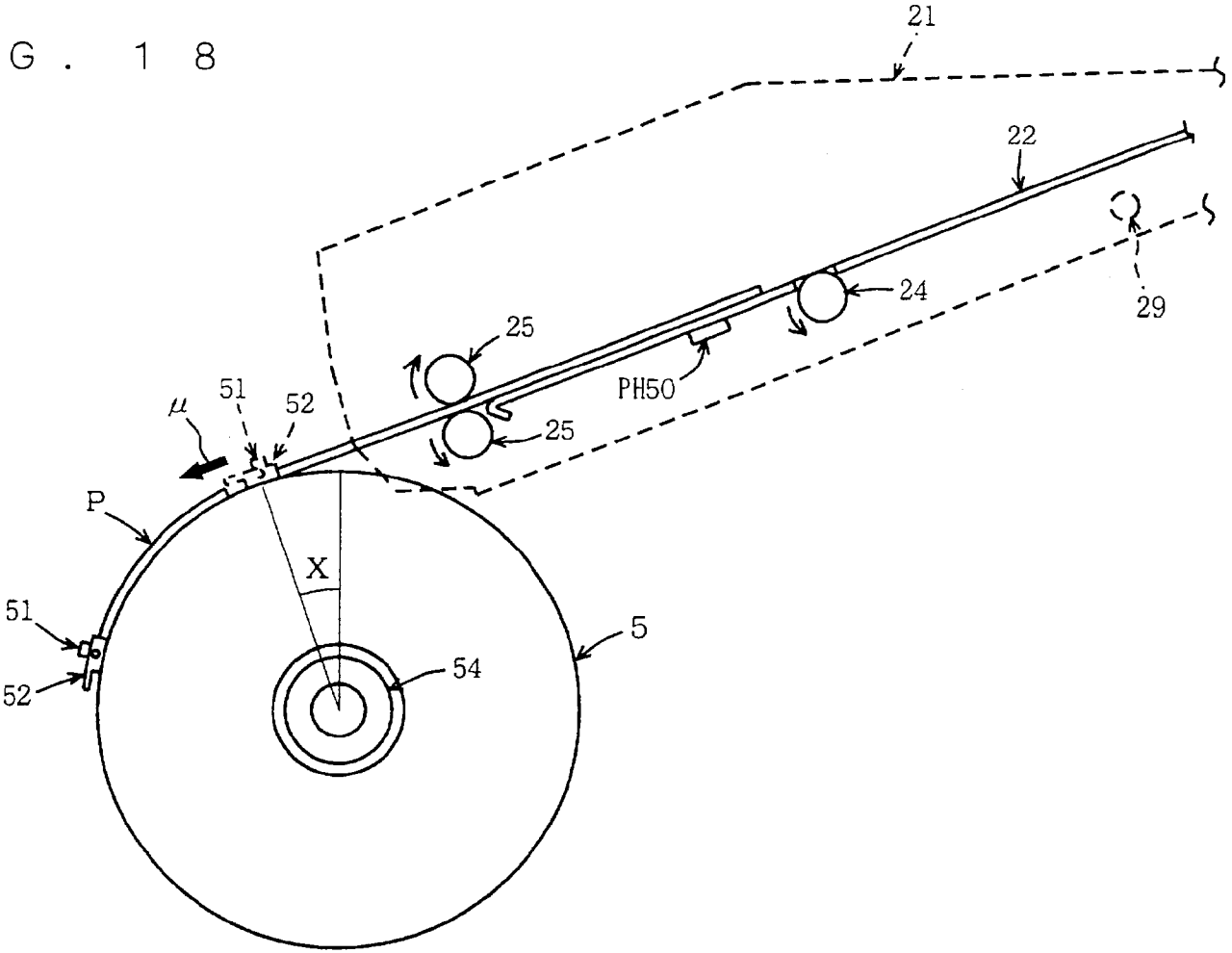
FIG. 18 is a view showing the printing plate being wound around the outer surface of the recording drum by the positive rotation of the recording drum.
Figure 19:
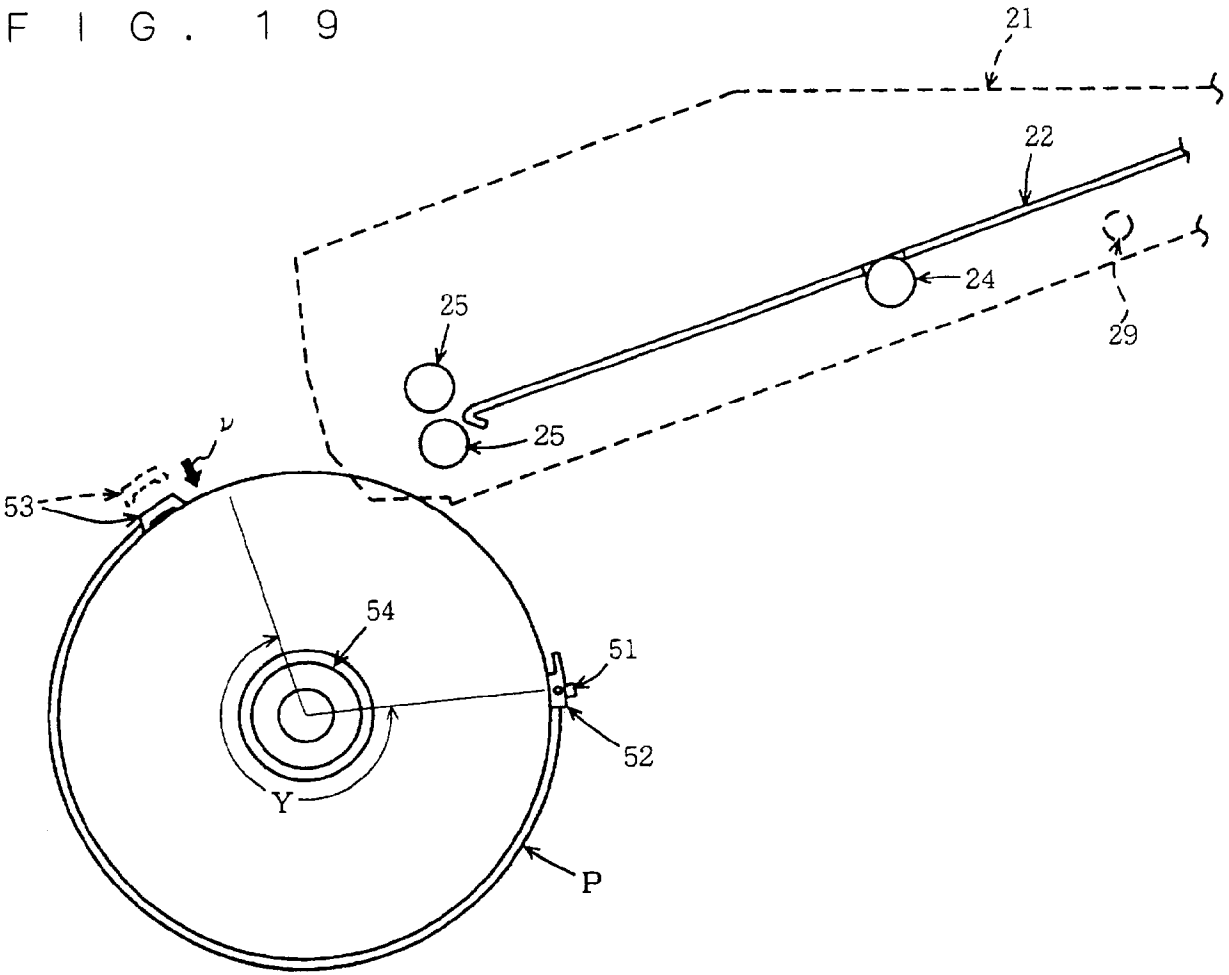
FIG. 19 is a view showing the leading edge clamp moved from the first angular position by the rotation of the recording drum.

By the positive rotation of the recording drum 5, the printing plate P is wound around the outer surface of the recording drum 5 while being discharged out of the lower tray 22, as shown in FIG. 18. While being wound around the recording drum 5, the printing plate P is pressed against the outer surface of the recording drum 5 by a squeeze roller (not shown), and is brought into intimate contact with the outer surface of the recording drum 5 by the vacuum suction created by the vacuum system described above. Then, the printing plate P is entirely discharged out of the lower tray 22 by the rotation of the transport rollers 25 and the recording drum 5. As shown in FIG. 19, when the leading edge clamps 52 reach a position at an angle Y from the first angular position X, the trailing edge of the printing plate reaches the second angular position Z just under the trailing edge clamps 53 being held by the third clamp driver.

At this point, the electrical component 7 stops driving the motor M1. This causes the trailing edge of the printing plate P to stop just under the trailing edge clamps 53 held by the third clamp driver. Then, the electrical component 7 drives the third clamp driver not shown, whereby the trailing edge clamps 53 are attached to the outer surface of the recording drum 5, as indicated by the arrow ν of FIG. 19. Thus, the trailing edge clamps 53 clamp the trailing edge of the printing plate P, thereby securing the trailing edge on the outer surface of the recording drum 5. As described hereinabove, the printing plate P is introduced into the punch unit 4, and is punched at correct locations. Thereafter, the printing plate P is introduced onto the recording drum 5, positioned, and mounted thereon.

<Positional Relationship between Punchers in Punch Unit 4>

Figure 20A:
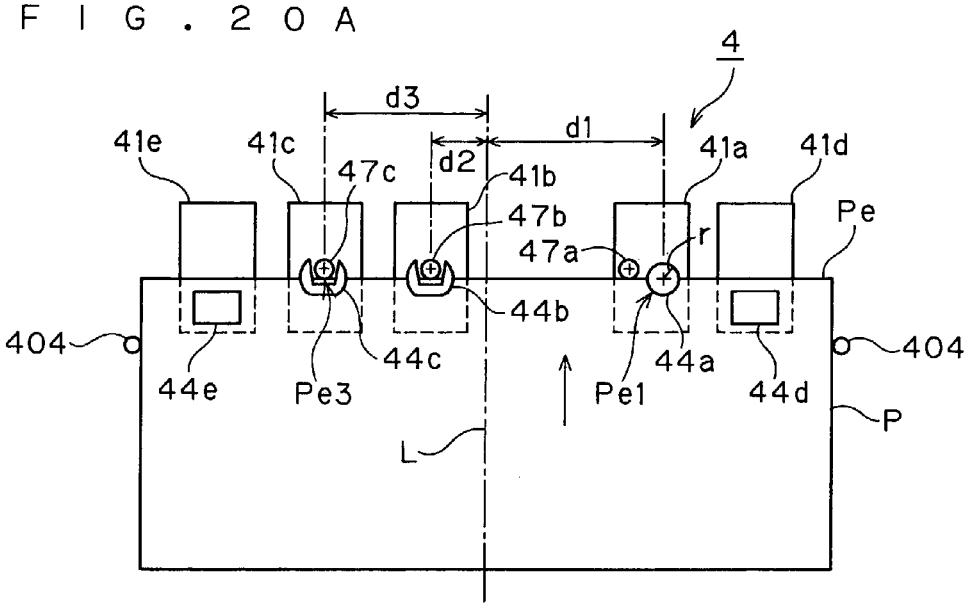
FIGS. 20A, 20B, 21A and 21B are schematic views showing the positioning of the printing plate on the punch unit and on the recording drum.
Figure 20B:
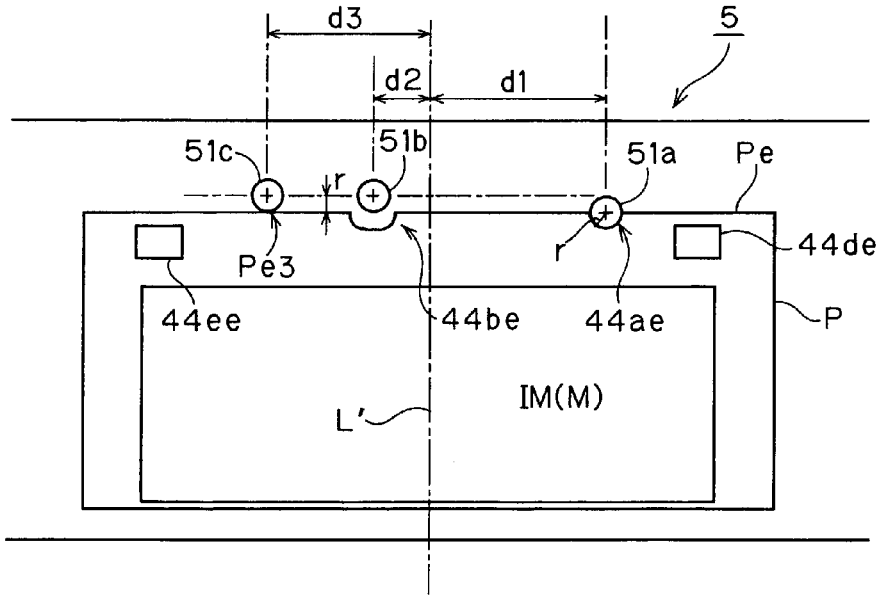
Figure 21A:
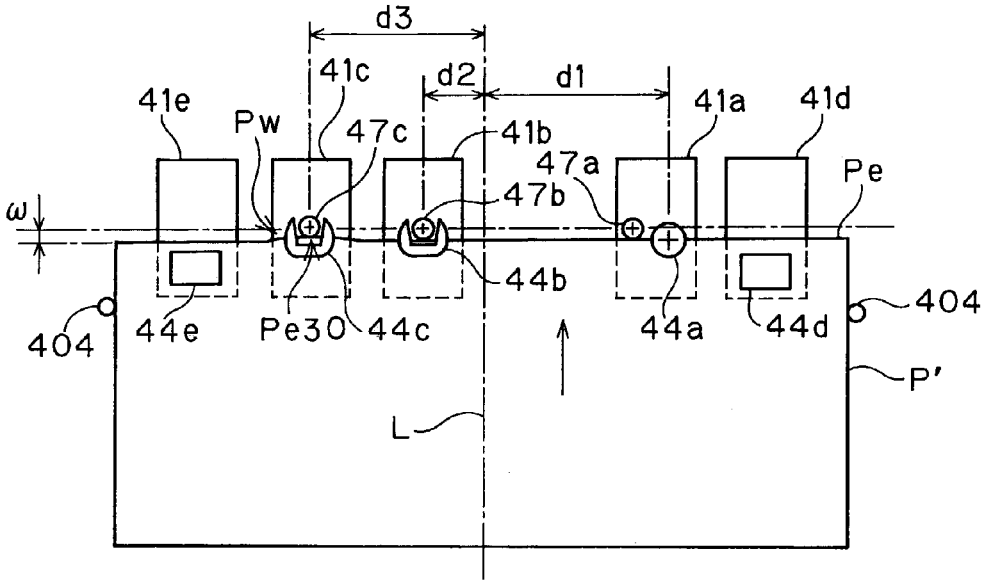
Figure 21B:
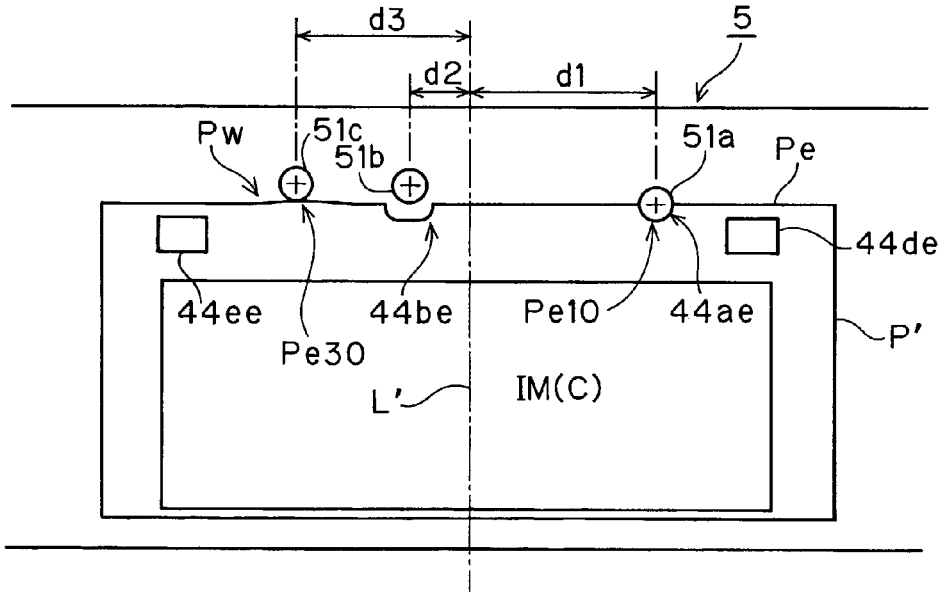
Figure 22A:
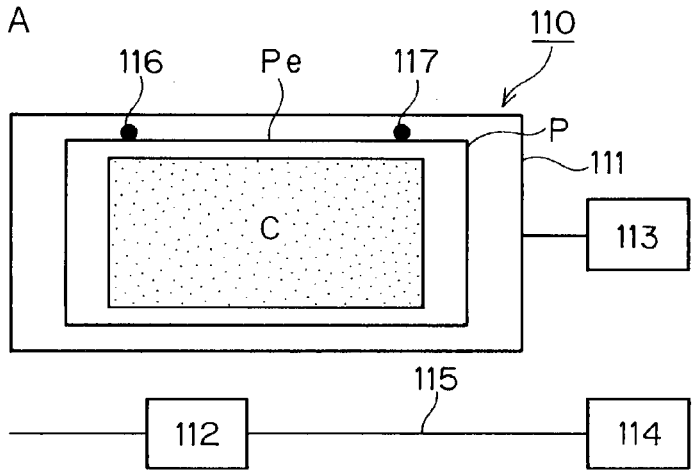
FIGS. 22A, 22B, 22C, 23A, 23B and 23C are schematic views showing a background art positioning method.
Figure 22B:
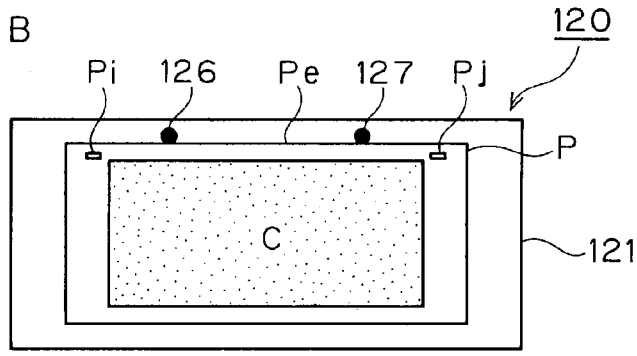
Figure 22C:
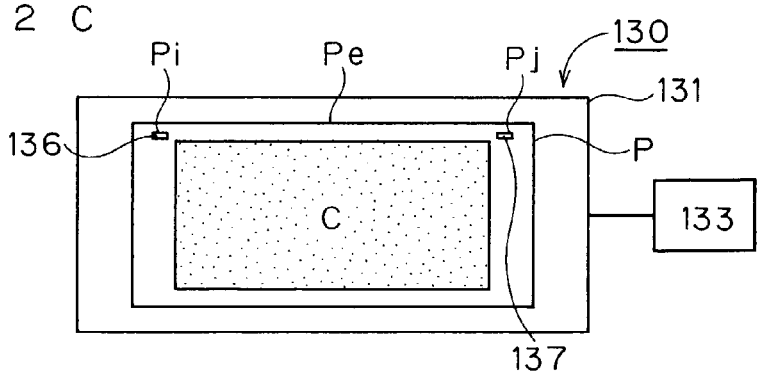
Figure 23A:
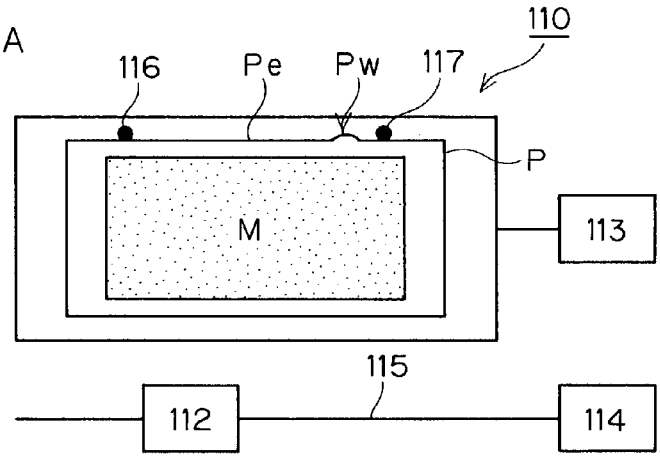
Figure 23B:
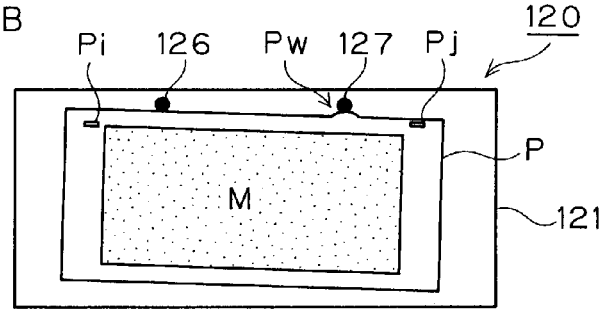
Figure 23C:
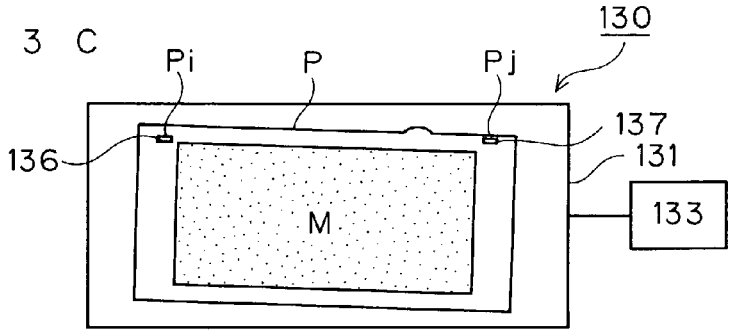

With reference to FIGS. 20A, 20B, 21A and 21B, description will be given on the specific locations and configurations of the notches and punched holes formed by the punchers 41*a* to 41*e* and of the positioning pins 51*a* to 51*c* provided on the recording drum 5. FIGS. 20A and 21A are schematic views showing that the notches and punched holes are formed in the printing plate P by using the punch unit 4. FIGS. 20B and 21B are schematic views showing that the printing plate P formed with the notches and punched holes by the punch unit 4 and moved onto the recording drum 5 is positioned using the three positioning pins 51*a* to 51*c*. For purposes of simplicity of description, irrelevant components will not be described.

As shown in FIG. 20A, the five punchers 41*a* to 41*e* are used to punch the printing plate P. As discussed above, the punchers 41*a* to 41*e* are provided with the punches 44*a* to 44*e*, respectively. The punchers 41*a* to 41*c* are provided with the reference pins 47*a* to 47*c*, respectively. The reference pins 47*a* to 47*c* are disposed so that the centers of the respective reference pins 47*a* to 47*c* fall in the same line perpendicular to a reference line L (to be described later).

The reference line L serving as a reference when positioning the printing plate P in a first direction perpendicular to a second direction in which the printing plate P is forwarded is determined in the punch unit 4. The reference line L substantially coincides with the center of the length of the punch unit 4. The five punchers 41*a* to 41*e* are disposed with respect to the reference line L.

In the punch unit 4, the positioning of the printing plate P in the first direction is carried out with respect to the central location. Specifically, the holding portions 404 of the centering bearings 402 hold the printing plate P in a location where the central location of the printing plate P coincides with the reference line L of the punch unit 4.

After the positioning of the printing plate P in the first direction, the printing plate P is then positioned in the second direction by bringing an edge Pe of the printing plate P into contact with two of the reference pins 47*a* to 47*c* of the punchers 41*a* to 41*c*. After the positioning of the printing plate P in the first and second directions, the punched holes and notches are formed in the printing plate P. In this process, the punchers 41*a* to 41*e* are selectively used depending on the length of the edge Pe of the printing plate P.

<Positional Relationship between Positioning Pins on Recording Drum 5>

When the printing plate P is mounted on the surface of the recording drum 5, the positioning of the printing plate P in the first direction is carried out also with respect to the central location. As illustrated in FIG. 20B, a reference line L' for mounting of the printing plate P is determined substantially centrally of the recording drum 5 in the direction of the axis of rotation thereof. The printing plate P is positioned on the recording drum 5 in the first direction so that the central location of the printing plate P in the first direction coincides with the reference line L'.

The three (first, second and third) positioning pins 51*a* to 51*c* are mounted upright on the recording drum 5. Each of the positioning pins 51*a* to 51*c* is cylindrical in shape and has a perfectly circular sectional configuration having a radius r equal to the radius of the punch 44*a*. The second and third positioning pins 51*b* and 51*c* are disposed at a distance r forward of the first positioning pin 51*a* in the forward direction (feed direction) of the printing plate P. The locations of the first to third positioning pins 51*a* to 51*c* in the first direction are determined with respect to the reference line L' in a manner to be described below.

The first positioning pin 51*a* is secured to the recording drum 5 so that a distance between the center of the first positioning pin 51*a* and the reference line L' is equal to a distance d1 between the center of the punch 44*a* and the reference line L in the punch unit 4. As mentioned above, the radius r of the first positioning pin 51*a* is equal to the radius of the punch 44*a* of the puncher 41*a*.

The second positioning pin 51*b* is secured to the recording drum 5 so that a distance between the center of the second positioning pin 51*b* and the reference line L' is equal to a distance d2 between the center of the reference pin 47*b* and the reference line L in the punch unit 4.

Likewise, the third positioning pin 51*c* is secured to the recording drum 5 so that a distance between the center of the third positioning pin 51*c* and the reference line L' is equal to a distance d3 between the center of the reference pin 47*c* and the reference line L in the punch unit 4.

For mounting of the printing plate P, two positioning pins are used: the first positioning pin 51*a*, and one of the second and third positioning pins 51*b* and 51*c*. The edge Pe of the printing plate P is brought into contact with the two positioning pins. The second and third positioning pins 51*b* and 51*c* are selectively used depending on the length of the edge Pe of the printing plate P to be mounted. Specifically, for mounting of a printing plate P having a relatively short edge Pe, the first positioning pin 51*a* and the second positioning pin 51*b* are used. On the other hand, for mounting of a printing plate P having a relatively long edge Pe, the first positioning pin 51*a* and the third positioning pin 51*c* are used.

In the latter case, for example, there is a likelihood that an undulation or swell on the edge Pe of the printing plate P comes in contact with the second positioning pin 51*b* to cause the third positioning pin 51*c* to be out of contact with the edge Pe. To prevent such a situation, prior to the positioning, the escape notch 44*be* is previously formed in a portion of the printing plate P which is to come near the second positioning pin 51*b* when the third positioning pin 51*c* is used for positioning of the printing plate P. FIG. 20B shows such a situation wherein the notch 44*be* is formed. When the second positioning pin 51*b* is used for positioning, a similar escape notch is formed in a portion of the printing plate P which is to come near the third positioning pin 51*c*.

The punching process step and the image formation process step will be described briefly. It is assumed that the first positioning pin 51*a* and the third positioning pin 51*c* are used for positioning. With reference to FIGS. 20A and 20B, it is also assumed that no undulations or swells are formed near portions of the edge Pe of the printing plate P which are to come into contact with the first and third positioning pins 51*a* and 51*c*.

When the printing plate P is transported toward the punch unit 4 in the direction indicated by the arrow shown in FIG. 20A, the holding portions 404 of the centering bearings 402 position the printing plate P in the first direction, and thereafter the edge Pe of the printing plate P is inserted into the punchers 41*a* to 41*e*. Next, as discussed above, a required escape notch is formed depending on the length of the edge Pe of the printing plate P to be used. The escape notch 44*be* is shown in FIG. 20B as formed by the second puncher 41*b*.

After the notch is formed, the printing plate P is slightly moved back in the direction opposite from the feed direction, and then transported again toward the punch unit 4. Since the escape notch 44*be* is previously formed in the edge Pe of the printing plate P, the printing plate P is brought into contact with only the first and third reference pins 47*a* and 47*c* without being affected by undulations or swells, if any, in a portion of the printing plate P corresponding to the escape notch 44*be*. This achieves the positioning of the printing plate P for the punching process step. At this time, the printing plate P is placed so that a line connecting the points of contact of the edge Pe of the printing plate P with the two reference pins is substantially parallel to a line connecting the centers of the reference pins 47*a* and 47*c*. The reference character Pe3 designates an edge portion of the printing plate P which is in contact with the third reference pin 47*c*.

After the printing plate P is placed in this manner, the printing plate P is secured in the clearances 45*a* to 45*e* of the respective punchers by a vacuum force. With the printing plate P thus secured to the punch unit 4, the puncher 41*a* forms the semicircular notch 44*ae* for use in positioning of the printing plate P on the recording drum 5. The deepest portion of the notch 44*ae* is referred to as an edge portion Pe1. At the same time that the notch 44*ae* is punched, the punchers 41*d* and 41*e* form the punched holes 44*de* and 44*ee* for use in positioning of the printing plate P in the printing apparatus.

After the punching process is completed, the printing plate P is moved onto the recording drum 5. The positioning of the printing plate P on the recording drum 5 is performed by fitting the first positioning pin 51*a* provided on the recording drum 5 into the positioning notch 44*ae* provided in the edge Pe of the printing plate P and by bringing the edge Pe of the printing plate P into contact with the third positioning pin 51*c* provided on the recording drum 5.

Positioning of the printing plate P in the first direction is achieved by bringing the notch 44*ae* into engagement with the first positioning pin 51*a*. Since the distance between the center of the first positioning pin 51*a* and the reference line L' is equal to the distance between the reference line L and the center of the punch 44*a* in the punch unit 4, this engagement provides proper registration of the center of the printing plate P.

Additionally, this engagement and the contact of the edge Pe with the third positioning pin 51*c* achieve the positioning of the printing plate P in the second direction.

The edge portion Pe3 of the printing plate P which made contact with the third reference pin 47*c* in the punch unit 4 will now be brought into contact with the third positioning pin 51*c*. This is because the positioning pins 51*a*, 51*c*, the punch 44*a* and the third reference pin 47*c* are disposed so that the center-to-center distance between the first and third positioning pins 51*a* and 51*c* is equal to the center-to-center distance between the first punch 44*a* and the third reference pin 47*c* in the punch unit 4.

After the positioning of the printing plate P is completed, the printing plate P is secured on the surface of the recording drum 5 by the leading edge clamps 52, the trailing edge clamps 53, and the vacuum produced at the suction holes and suction grooves 55 in the surface of the recording drum 5. Thereafter, the exposure head 6 forms an image IM on the surface of the printing plate P. It is assumed that the image IM (M) for a magenta plate is formed in FIG. 20B.

Process steps until the recording of an image on another printing plate P' will be described with reference to FIGS. 21A and 21B. It is assumed that an undulation or swell Pw is formed on the edge Pe near a portion of the printing plate P' which is to come in contact with the third positioning pin 51*c*. It is also assumed that the printing plate P' is a cyan plate.

In a manner similar to that described above, the printing plate P' is transported toward the punch unit 4 in the direction indicated by the arrow shown in FIG. 21A, and the holding portions 404 of the centering bearings 402 position the printing plate P' in the first direction. Thereafter, the edge Pe of the printing plate P' is inserted into the punchers 41*a* to 41*e*, and the second puncher 41*b* forms an escape notch 44*be*.

After the notch is formed, the printing plate P' is slightly moved back, and then transported again toward the punch unit 4. Since the escape notch 44*be* is previously formed in the edge Pe of the printing plate P', the printing plate P' does not make contact with the second reference pin 47*b*. However, since the undulation or swell Pw is formed on the edge Pe near the portion of the printing plate P' which is to come in contact with the third reference pin 47*c*, the third reference pin 47*c* comes into contact with the undulation or swell Pw. As a result, although the holding portions 404 hold righthand and lefthand portions of the printing plate P', the printing plate P' is positioned in an orientation inclined at a slight angle ω with respect to a line connecting the center of the first reference pin 47*a* and the center of the third reference pin 47*c*. A portion of the printing plate P' which is to come in contact with the third reference pin 47*c* is referred to as an edge portion Pe30.

After the printing plate P' is positioned in this manner, the printing plate P' is secured in the clearances 45*a* to 45*e* of the respective punchers 41*a* to 41*e*, and the puncher 41*a* forms a notch 44*ae* for use in positioning of the printing plate P' on the recording drum 5. The deepest portion of the notch 44*ae* is referred to as an edge portion Pe10. At the same time that the notch 44*ae* is punched, the punchers 41*d* and 41*e* form punched holes 44*de* and 44*ee* for use in positioning of the printing plate P' in the printing apparatus.

After the punching process is completed, the printing plate P' is moved onto the recording drum 5. The positioning of the printing plate P' on the recording drum 5 is performed by fitting the first positioning pin 51*a* into the positioning notch 44*ae* and by bringing the edge Pe of the printing plate P' into contact with the third positioning pin 51*c*. After the positioning of the printing plate P' is completed, the printing plate P' is secured on the surface of the recording drum 5. Thereafter, an image IM (C) for a cyan plate is recorded on the surface of the printing plate P'.

Because of the presence of the undulation or swell Pw on the edge Pe of the printing plate P', the printing plate P' is secured in an inclined orientation on the recording drum 5. However, the angle of inclination of the printing plate P' is equal to the slight angle ω of inclination produced when the punch unit 4 performs the punching process to form the positioning notch 44*ae* and the punched holes 44*de* and 44*ee* for use in positioning in the printing apparatus. This is because the positioning pins 51*a*, 51*c*, the punch 44*a* and the third reference pin 47*c* are disposed so that the printing plate P' is positioned on the recording drum 5 under substantially the same conditions as those satisfied when the printing plate P' is positioned on the punch unit 4.

Thus, the positional relationship between the punched holes 44*de* and 44*ee* for use in positioning in the printing apparatus and the recorded image IM (C) relative to each other on the printing plate P' having the undulation or swell Pw in its portion for contact with the third reference pin 47*c* is identical with that on the printing plate P having no undulation or swell. In other words, the positional relationship between the recorded image IM (C) for the cyan plate and the punched holes 44*de* and 44*ee* for use in positioning in the printing apparatus is identical with the positional relationship between the recorded image IM (M) for the magenta plate and the punched holes 44*de* and 44*ee* for use in positioning in the printing apparatus. Therefore, no color misregistration occurs in a printed image if the printing plate P and the printing plate P' are used to print on the same printing sheet.

<Modifications>

In the above-mentioned preferred embodiment, the notch 44*ae* in the edge Pe of the printing plate P is brought into engagement with the positioning pin 51*a* on the recording drum 5. However, it is not necessary that the printing plate P is formed with the notch for use in positioning on the recording drum 5. For example, the edge Pe may be brought into direct contact with a predetermined positioning pin mounted upright on the recording drum 5. In this case, however, a means for positioning the printing plate P in the first direction is required. As an example, a member similar to the holding portions 404 of the centering bearings 402 in the punch unit 4 is required to position the printing plate P in the first direction. Moreover, in such a case, the printing plate P may be positioned in the first direction so that an edge of the printing plate P perpendicular to the edge Pe coincides with the reference lines of the punch unit 4 and the recording drum 5, instead of the positioning with respect to the central position.

Further, the printing plate P is secured on the mounting member (i.e., the recording drum) of the type having a cylindrical outer surface, in the above-mentioned preferred embodiment, for image recording. The present invention, however, is applicable to an apparatus for recording an image on a printing plate P secured on a mounting member of the type having a cylindrical inner surface or an apparatus for recording an image on a printing plate P secured on a planar mounting member.

Additionally, the notch for use in positioning of the printing plate on the recording drum and the punched holes for use in positioning thereof in the printing apparatus are formed by the punch unit 4 provided in the image recorder in the above-mentioned preferred embodiment. The present invention, however, is applicable to the formation of either or both of the notch and the punched holes by means of a punch unit outside the image recorder. The punched holes for use in positioning of the printing plate in the printing apparatus may be formed either before or after the image recording.

The punched holes for use in positioning of the printing plate in the printing apparatus are of a rectangular configuration in the above-mentioned preferred embodiment. The present invention, however, is applicable to punched holes of other configurations or to notches instead of the punched holes.

While the invention has been described in detail, the foregoing description is in all aspects illustrative and not restrictive. It is understood that numerous other modifications and variations can be devised without departing from the scope of the invention.

What is claimed is:

1. An image recorder for recording a printing image on a printing plate, comprising:

a) a transport element for transporting said printing plate to a predetermined position;

b) a reference position determining element for determining a predetermined reference position on said printing plate, said reference position determining element including b-1) a first holding element for holding a first portion of a front edge of said printing plate, b-2) a pair of second holding elements for holding at least one of second portions of said front edge of said printing plate, b-3) a first reference establishing element for establishing a first reference indication for image recording in said front edge of said printing plate, and b-4) a second reference establishing element for establishing a second reference indication for printing in said printing plate; and c) a recording element for recording a printing image on said printing plate, said recording element including c-1) a third holding element for holding a third portion of said front edge of said printing plate, c-2) a pair of fourth holding elements for holding at least one of fourth portions of said front edge of said printing plate, and c-3) an image recording element for recording a printing image on said printing plate, wherein said first reference establishing element and each of said pair of second holding elements are spaced apart from each other in a direction substantially perpendicular to a direction in which said printing plate is transported to said recording element, and said third holding element and said each of said pair of fourth holding elements are provided to satisfy the following conditions:

(i) said third holding element and said each of said pair of fourth holding elements are spaced apart from each other in a direction substantially perpendicular to a direction in which said printing plate is transported to said recording element;

(ii) the positional relationship between said third holding element and said each of said pair of fourth holding elements relative to each other in a horizontal plane is identical with the positional relationship between said first reference establishing element and said each of said pair of second holding elements relative to each other in a horizontal plane; and (iii) said pair of fourth holding elements are provided in corresponding relation to a portion of said front edge of said printing plate which is held by said pair of second holding elements during the determination of said reference position.

2. The image recorder according to claim 1, wherein said first and second reference establishing elements are first and second punching elements, respectively, for punching said printing plate; and said first reference indication is a notch formed by said first punching element, and said second reference indication is a hole formed by said second punching element.

3. The image recorder according to claim 1, wherein said first reference establishing element is a positioning element adapted to come into contact with a portion of said front edge of said printing plate when said printing plate is held by said first holding element and at least one of second holding elements; and said first reference indication is said portion of said front edge of said printing plate which is to come into contact with said positioning element at that time.

4. The image recorder according to claim 2, wherein said reference position determining element further includes b-5) an escape region forming element for selectively forming an escape region in a portion of said printing plate which is near one of said pair of fourth holding elements when said printing plate is held on said recording element.

5. The image recorder according to claim 4, wherein said escape region forming element is a third punching element for punching said printing plate, and said escape region is said notch formed by a third punching element.

6. A method of recording a printing image on a printing plate, comprising the steps of:

a) transporting said printing plate to a predetermined position;

b) determining a predetermined reference position on said printing plate, said step b) including the steps of b-1) holding a first portion of a front edge of said printing plate by means of a first holding element, and holding at least one of second portions of said front edge of said printing plate by means of a pair of second holding elements, b-2) establishing a first reference indication for image recording in said printing plate by means of a first reference establish element, and b-3) establishing a second reference indication for printing in said printing plate by means of a second reference establish element; and c) recording a printing image on said printing plate, said step c) including the steps of c-1) holding a third portion of said front edge of said printing plate by means of a third holding element, and holding at least one of fourth portions of said front edge of said printing plate by means of a pair of fourth holding elements, and c-2) recording a printing image on said printing plate, wherein said first reference establishing element and each of said pair of second holding elements are spaced apart from each other in a direction substantially perpendicular to a direction in which said printing plate is transported to said recording element, and said third holding element of said each of said pair of fourth holding elements is provided to satisfy the following conditions:

(i) said third holding element and said each of said pair of fourth holding elements are spaced apart from each other in a direction substantially perpendicular to a direction in which said printing plate is transported in step c);

(ii) the positional relationship between said third holding element and said each of said pair of fourth holding elements relative to each other in a horizontal plane is identical with the positional relationship between said first reference establishing element of said each of said pair of second holding elements relative to each other in a horizontal plane; and (iii) said pair of fourth holding elements are provided in corresponding relation to a portion of said front edge of said printing plate which is held by said pair of second holding elements during the determination of said reference position.

7. The method according to claim 6, wherein said step b-2) includes the step of performing a first punching process on said printing plate;

said step b-3) includes the step of performing a second punching process on said printing plate;

said first reference indication is a notch formed in said first punching process; and said second reference indication is a hole formed in said second punching process.

8. The method according to claim 6, wherein said step b-2) includes the step of bringing a portion of said front edge of said printing plate into contact with a predetermined positioning element when said printing plate is held by said first holding element and at least one of second holding elements, thereby to position said printing plate; and said first reference indication is said portion of said front edge of said printing plate which is to come into contact with said predetermined positioning element at that time.

9. The method according to claim 7, wherein said step b) further includes the step of b-4) selectively forming an escape region in a portion of said printing plate which is near one of said pair of fourth holding elements when said printing plate is held in said step c).

10. The method according to claim 9, wherein said step b-4) is said step of performing a third punching process on said printing plate, and said escape region is said notch formed in a third punching process.

* * * * *